US012623801B2

(12) United States Patent
Ferris et al.

(10) Patent No.: US 12,623,801 B2
(45) Date of Patent: May 12, 2026

(54) APPARATUS AND METHOD FOR PRODUCING TUBULAR PACKAGES

(71) Applicant: INTERCONTINENTAL GREAT BRANDS LLC, East Hanover, NJ (US)

(72) Inventors: Kevin Ferris, Bournville (GB); Daniel Bortos, Loerrach (DE); Leesha Muman, Bournville (GB); Ben Thistleton, Leicestershire (GB); Phillip Loxley, Leicestershire (GB); Colin Bosworth, Leicestershire (GB)

(73) Assignee: INTERCONTINENTAL GREAT BRANDS LLC, East Hanover, NJ (US)

( * ) Notice: Subject to any disclaimer, the term of this patent is extended or adjusted under 35 U.S.C. 154(b) by 231 days.

(21) Appl. No.: 17/291,602

(22) PCT Filed: Feb. 4, 2020

(86) PCT No.: PCT/IB2020/000033
§ 371 (c)(1),
(2) Date: May 5, 2021

(87) PCT Pub. No.: WO2020/174276
PCT Pub. Date: Sep. 3, 2020

(65) Prior Publication Data

US 2021/0387757 A1 Dec. 16, 2021

(30) Foreign Application Priority Data

Feb. 27, 2019 (GB) ..... 1902605

(51) Int. Cl.
*B29C 53/52* (2006.01)
*B29C 53/54* (2006.01)
(Continued)

(52) U.S. Cl.
CPC ..... *B65B 9/067* (2013.01); *B65B 2009/063* (2013.01); *B65B 2220/08* (2013.01)

(58) Field of Classification Search
CPC .. B65B 7/20; B65B 9/06; B65B 9/067; B65B 9/087; B65B 49/02; B65B 2009/063; B65B 2220/08; B29C 53/52; B29C 53/54
(Continued)

(56) References Cited

U.S. PATENT DOCUMENTS 3,335,540 A * 8/1967 Reil ..... B65B 9/12 53/551
3,532,516 A 10/1970 Erekson
(Continued)

FOREIGN PATENT DOCUMENTS

EP 0084299 A1 7/1983
EP 0119957 A1 9/1984
(Continued)

OTHER PUBLICATIONS

Non-Final Office Action issued in U.S. Appl. No. 17/291,589 dated Apr. 27, 2023; 21 pages.
(Continued)

*Primary Examiner* — Stephen F. Gerrity
*Assistant Examiner* — Patrick B Fry
(74) *Attorney, Agent, or Firm* — CANTOR COLBURN LLP

(57) ABSTRACT

Apparatus (10) for producing tubular packages includes a packaging material dispenser (12) and a forming section (20). The forming section (20) comprises a progressive folding region (26*a*, FIG. 8) having a plurality of discrete, elongate external guide surfaces (50, 52, 54, 56) extending generally in the machine direction (A). The elongate external guide surfaces are spaced apart from one another and configured for contact with an outer surface of the packaging
(Continued)

material so as to progressively guide and fold the packaging material about a longitudinal axis from a planar configuration into a tubular structure. The elongate guide surfaces may be arcuate and may be provided by means of guide rods. The apparatus may be a horizontal or vertical form, fill seal type apparatus. The packaging material (14) may be a semi-rigid packaging material such as paperboard, cartonboard, or semi-rigid plastics.

20 Claims, 11 Drawing Sheets

(51) Int. Cl.

| | |
|---|---|
| ***B65B 7/20*** | (2006.01) |
| ***B65B 9/06*** | (2012.01) |
| ***B65B 9/067*** | (2012.01) |
| ***B65B 9/087*** | (2012.01) |
| ***B65B 49/02*** | (2006.01) |

(58) Field of Classification Search
USPC ..... 53/233, 450, 550; 156/203; 198/346
See application file for complete search history.

(56) References Cited

U.S. PATENT DOCUMENTS

| | | | | |
|---|---|---|---|---|
| 3,716,962 | A * | 2/1973 | Langen | B65B 7/20 53/209 |
| 4,587,794 | A | 5/1986 | Kopp | |
| 4,603,536 | A * | 8/1986 | de la Poype | B65B 9/20 53/410 |
| 4,640,081 | A | 2/1987 | Kawaguchi et al. | |
| 5,609,237 | A * | 3/1997 | Lenhart | B65G 47/248 198/417 |
| 6,574,944 | B2 * | 6/2003 | Capodieci | B29C 65/7443 53/DIG. 2 |
| 6,986,236 | B2 * | 1/2006 | Schneider | B65B 9/06 53/450 |
| 7,269,559 | B2 | 9/2007 | Kondo et al. | |
| 7,694,499 | B2 * | 4/2010 | Ballestrazzi | B65B 9/067 53/139.5 |
| 8,443,961 | B2 * | 5/2013 | Hamm | B65G 47/1407 193/25 FT |
| 2002/0194816 | A1 | 12/2002 | Schneider et al. | |
| 2004/0173492 | A1 * | 9/2004 | Kane, Jr. | B65D 33/2533 53/139.2 |
| 2013/0097965 | A1 | 4/2013 | Honegger | |
| 2021/0403185 | A1 | 12/2021 | Ferris et al. | |

FOREIGN PATENT DOCUMENTS

| | | | |
|---|---|---|---|
| EP | 3072821 | A1 | 9/2016 |
| JP | S59174411 | A | 10/1984 |
| JP | 06191528 | A | 7/1994 |
| JP | 4857468 | B2 | 1/2012 |

OTHER PUBLICATIONS

International Search Report for International Application No. PCT/IB2020/000033; International Filing Date: Feb. 4, 2020; Date of Mailing: Apr. 21, 2020; 4 pages.
International Search Report for International Application No. PCT/IB2020/000035; International Filing Date: Feb. 4, 2020; Date of Mailing: May 27, 2020; 3 pages.
Written Opinion for International Application No. PCT/IB2020/000033; International Filing Date: Feb. 4, 2020; Date of Mailing: Apr. 21, 2020; 7 pages.
Written Opinion for International Application No. PCT/IB2020/000035; International Filing Date: Feb. 4, 2020; Date of Mailing: May 27, 2020; 7 pages.
Japanese Office Action issued in Japanese Patent Application No. 2021-546270, date of drafting Jul. 26, 2022.
Non-Final Office Action issued in U.S. Appl. No. 17/291,589 dated Jan. 5, 2024; 22 pages.

* cited by examiner

APPARATUS AND METHOD FOR PRODUCING TUBULAR PACKAGES

CROSS REFERENCE TO RELATED APPLICATIONS

This application is a National Stage application of PCT/IB2020/000033, filed Feb. 4, 2020, which claims the benefit of GB Application No. 1902605.3, filed Feb. 27, 2019, both of which are incorporated by reference in their entirety herein.

TECHNICAL FIELD OF THE INVENTION

The present invention relates to apparatus and methods for packaging. The apparatus and methods are especially, but not exclusively, suitable for packaging items in tubular packaging made from a semi-rigid packaging material, such as paperboard, cartonboard, and semi-rigid plastic, in a substantially continuous process.

BACKGROUND TO THE INVENTION

It is known to provide so-called flow-wrap packaging which consists of a flexible tubular container closed at either end, normally with crimping or embossing to provide patterned transverse sealing portions.

In general, this type of flow-wrap packaging is manufactured by horizontal or vertical form, fill and seal processes (HFFS or VFFS). In HFFS processes, a flexible packaging film is run through machinery which folds the material around an item and then clamps and seals the ends of the folded material followed by cutting, to provide a sealed packaging. Such packaging can be run through appropriate machinery relatively rapidly, in order to produce many filled packages per minute. Examples of such machinery include the Pack 401 Horizontal Flow Wrapper supplied by Bosch GmbH, Germany and the Horizontal Form Fill Seal Packaging Machine 8000 MH supplied by Ossid, USA.

The flexible films conventionally used for flow-wrap packaging generally comprise polymeric materials and are relatively strong, resistant to tearing, highly flexible, and with low dead-fold properties. The known HFFS or VFFS processes and apparatus have been developed to take advantage of these characteristics in wrapping the film about the item being packed and sealing the package. In a typical arrangement, a continuous length of film is drawn from a roll on to a former. The film engages the former on one side and is drawn along the former conforming to its shape. The shape of the former gradually changes along its length and is configured so that the film is directed to move in the machine direction and folded into a tube-like structure as it passes over the former. The item being packaged is introduced into the partially folded packaging film so that the film is wrapped about the item and overlapping longitudinally extending lateral edge regions are sealed together to form a longitudinal seal. Opposed regions of the film are sealed together at either end of the item to form transverse end seals and each package is cut to separate it from the length of film. In some arrangements, it is the inner surface of the film (that is to say the surface which is directed toward the item once the packaging is formed) that engages with the shaped former whilst in others it is the outer surface of the film which engages the former.

The known HFFS flow-wrap arrangements are particularly suitable for packaging items that are substantially rigid. Products such as candy and chocolate bars and other food products which are rigid at the temperatures encountered during packaging are often packaged in this manner. Flowable products can also be flow-wrapped using HFFS arrangements if they are first placed in a generally rigid inner container and the flow-wrapped package formed about the filled container. The term "rigid" in this context should be understood as meaning that the item maintains its shape during packaging rather than being flowable. Looked at another way, it can be said that "rigid" items are generally dimensionally stable during packaging.

In a typical HFFS arrangement, the packaging film is drawn down on to the former from above at an oblique angle to the horizontal and the former turns the material on to a horizontal flow path whilst also folding or wrapping it longitudinally to form a tube about the item being packaged. This requires the material to be folded in multiple directions or planes at the same time. Whilst this is achievable with the highly flexible polymeric films typically used in flow-wrap packaging, it presents difficulties with semi-rigid materials having greater dead-fold properties as the material will tend to bulge and crease undesirably if folded by a significant amount in more than one direction or plane at the same time.

It would therefore be advantageous to provide apparatus for packaging a series of items in packages produced sequentially from a substantially continuous length of packaging material suitable for use with a broader range of packaging materials.

It would be particularly advantageous to provide apparatus for packaging a series of items in packages produced sequentially from a substantially continuous length of packaging material suitable for use with packaging materials comprising paperboard, cartonboard, semi-rigid plastics or other semi-rigid packaging materials.

It would also be advantageous to provide a method of packaging a series of items in packages produced sequentially from a substantially continuous length of packaging material suitable for use with a broader range of packaging materials.

It would be particularly advantageous to provide a method of packaging a series of items in packages produced sequentially from a substantially continuous length of packaging material suitable for use with packaging materials comprising paperboard, cartonboard, semi-rigid plastics or other semi-rigid packaging materials.

It is therefore an aim of embodiments of the present invention to overcome or mitigate at least some of the problems of the prior art.

SUMMARY OF THE INVENTION

Aspects of the invention relate to apparatus and methods for packaging items.

In accordance with a first aspect of the invention, there is provided apparatus for producing tubular packages sequentially from an initially generally flat, substantially continuous length of packaging material, each package enclosing one of a series of items conveyed through the apparatus in a machine direction in use, the apparatus comprising:

a) a packaging material dispenser arranged to dispense a substantially continuous length of packaging material and convey the material in the machine direction; and, b) a forming section through which the packaging material is conveyed in the machine direction, the forming section being configured to fold the packaging material from an initially flat configuration into a tubular package structure, the forming section comprising a progressive folding region having a plurality of discrete, elongate external guide surfaces extending generally in the machine direction, the elongate external guide surfaces being spaced apart from one another and configured for contact with an outer surface of the packaging material so as to progressively fold the packaging material about a longitudinal axis extending in the machine direction as the material passes through the progressive folding region.

Terms such as "fold", "folding", and the like as used herein in relation to the packaging material should be understood as encompassing arrangements in which the packaging material is wrapped, bent or turned but which do not necessarily produce crease lines in the material unless the requirement for a crease line is explicitly stated.

The apparatus may be configured for use in manufacturing packaging from semi-rigid packaging material. The term "semi-rigid" refers to or includes a material which can be folded about an item during packaging but which is sufficiently rigid that it exhibits dead-fold characteristics. The apparatus may be configured for use in manufacturing packaging from semi-rigid materials such as paperboard, cartonboard, cardboard, or semi-rigid polymeric materials, including combinations of such materials and laminated materials which include at least one layer of such materials. Where the packaging material is cartonboard, it may comprise multiple layers of fibres and may comprise at, least three layers of fibres. The apparatus may be configured for use in manufacturing packaging from packaging material comprising paperboard or cartonboard having a weight of 150 g/sqm or more. The apparatus may be configured for use in manufacturing packaging from packaging material comprising paperboard or cartonboard having a weight in the range of 150 g/sqm to 250 g/sqm. Where the apparatus is configured for use in manufacturing packaging from semi-rigid polymeric materials, it may be configured for use in manufacturing packaging from a semi-rigid polymeric material having a thickness of 150 μm or more, or a thickness of 200 μm or more. The apparatus may be configured for use in manufacturing packaging from packaging material which is coated or otherwise provided with adhesive or other material for producing seals, such as a heat sealing layer. The apparatus may be configured for use in manufacturing packaging from packaging material which is printed on and/or coated in a protective layer. The apparatus may be configured for use in manufacturing packaging from packaging material which includes a metal or metallised layer and/or a barrier layer.

The elongate external guide surfaces may be arcuate in lateral cross section.

The elongate external guide surfaces may make a line contact with the packaging material.

At least some of the elongate external guide surfaces may be symmetrically disposed about said longitudinal axis.

When considered from an upstream end to a downstream end, at least some of the elongate external guide surfaces may be angled laterally inwardly and in a vertical plane. The machine direction may be horizontal and at least part of said at least some of the elongate external guide surfaces may be angled laterally inwardly and upwardly from their upstream end towards their downstream end.

The apparatus may comprise one or more elongate external guide members which define the elongate external guide surfaces. In an embodiment, the apparatus has guide members in the form of rods or the like. In an embodiment, each guide member defines at least part of a respective one of the elongate external guide surfaces. At least one of the guide members may comprise a cylindrical rod. In an embodiment, the guide members are supported at one end at least by a support member having an aperture through which the packaging material and items to be packaged pass. The guide members in this embodiment may be mounted to the support member about a periphery of the aperture. The guide members may be supported at either end by a respective support member. The, or a, support member may be a plate.

The progressive folding region may comprise one or more elongate external guide members which are configured to define a cage or funnel through which the packaging material is passed in use, wherein the one or more elongate external guide members define said elongate external guide surfaces.

At least one of the elongate external guide surfaces may be discontinuous. For example, instead of using a single continuous rod to define an elongate external guide surface, a series of rods can be used to define an elongate external guide surface. This may be beneficial in reducing frictional contact between the guide surfaces and the packaging material. The rods in a series may be spaced apart in the machine direction and may be aligned along a common axis.

At least some of the elongate external guide surfaces may extend parallel to one another in a common first plane. At least some other of the elongate external guide surfaces may extend parallel to one another in a second common plane different from the first common plane.

In an embodiment, the apparatus further comprises an item conveyancing arrangement for conveying a series of items to be packaged in the machine direction and sequentially positioning each item proximal to the packaging material at a location such that, in use, the packaging material is subsequently folded about the item. In an embodiment, the item conveyancing arrangement is configured to insert each item into the partially folded packaging material at a location such that inserted items are conveyed between the elongate external guide surfaces over at least part of their length. In this embodiment, the apparatus is configured such that the items are inserted into the partially folded packaging material, with packaging material being located between each item and the elongate external guide surfaces. The item conveyancing arrangement may be configured to insert items into the partially folded packaging material at the upstream end of the progressive folding region. The item conveyancing arrangement may comprise elongate guides for supporting the items from below and along which the items can slide. The item conveyancing may also comprise a circulating drive member, such as a belt or chain, which over part of its length runs parallel to the guides. The drive member may have a number of drive formations (e.g. pegs) spaced along its length, each being configured to engage an end of an item and move it in the machine direction along the guides such that the items are maintained at a set spacing from one another and moved along the guides.

The forming section may also comprise at least one package former, the, or each, package former defining a packaging material folding channel through which the packaging material is conveyed, the folding channel of the, or each, of the package formers being shaped to fold the packaging material about said longitudinal axis as it passes towards and through the folding channel in use. The forming section may comprise at least one package former located upstream of the progressive folding region in the machine direction. The folding channel of the at least one package former may be configured to fold side regions of the initially flat packaging material out of the plane of the initially flat packaging material. Where the machine direction is horizontal, the folding channel of the at least one package former may be configured to fold side regions of the initially flat packaging material downwardly relative to a central region of the packaging material. The folding channel may be generally in the shape of an inverted "U". A package former may comprise a body in which the packaging material folding channel is defined at least in part by means of an aperture through the body. The body may be a plate. The package former, or at least one of them, may be provided with at least one guide for leading the packaging material into or out of the aperture. Alternatively, a package former may comprise two separate members profiled and spaced apart to define the packaging material folding channel between them.

The progressive folding region may comprise one or more internal guide surfaces for engagement with an inner surface of the packaging material.

The apparatus may be configured to package generally block shaped items having opposed first and second major faces and opposed sides, in which case, the progressive folding region may comprise at least one first elongate external guide surface configured for holding the packaging material proximal a first major face of items conveyed through the progressive folding region and a pair of second elongate external guide surfaces, each second elongate external guide surface configured to hold a portion of the packaging material proximal a respective side of the items. The progressive folding region may further comprise a pair of third elongate external guide surfaces, each third elongate external guide surface being configured to progressively fold a respective side region of the packaging material into close proximity with the second major face of the items as the packaging material and items traverses from an upstream end of the progressive folding region to a downstream end. Each of the third elongate external guide surfaces may be angled laterally inwardly and in a plane perpendicular to the machine direction when considered from an upstream end to a downstream end. Each of the third elongate external guide surfaces may be angled laterally inwardly and upwardly when considered from an upstream end to a downstream end The apparatus may be configured to produce packages in which outer lateral edge regions of the packaging material are bonded together to form a longitudinal fin seal, in which case, the apparatus may comprise a guide arrangement at a downstream end of the progressive folding region for holding the outer lateral edge portions in close proximity and projecting away from the second major face of the items. The guide arrangement may comprise a support member, such as a plate, defining a slot through which the outer lateral edge portions pass.

The forming section may extend over a length as measured in the machine direction of 1 m or more, or 1.5 m or more, or 2 m or more or 3 m or more. Alternatively, forming section may extend over a length as measured in the machine direction which is at least 3 times the length of the package the apparatus is configured to produce, or at least 4 times the length of the package the apparatus is configured to produce, or at least 5 times the length of the package the apparatus is configured to produce, or at least 6 times the length of the package the apparatus is configured to produce. Alternatively, the forming section may extend over a length as measured in the machine direction which is at least 7 times the width of the package the apparatus is configured to produce, or at least 8 times the width of the package the apparatus is configured to produce, or at least 9 times the width of the package the apparatus is configured to produce, or at least 10 times the width of the package the apparatus is configured to produce.

The apparatus may be configured such that at least part of the packaging material travels through the entire forming section in a substantially constant plane substantially parallel with, or which includes, said longitudinal axis. The forming section may be configured such that the direction of folding of the packaging material at any given point along the folding section is substantially exclusively in a plane perpendicular to said longitudinal axis.

The apparatus may comprise one or more elongate item support members extending generally in the machine direction and configured for supporting an item being packed. The one or more elongate item support members may be positioned so as to extend within the partially folded packaging material in use.

The apparatus may comprise an arrangement for scoring, debossing and/or pre-creasing the packaging material. An arrangement for scoring, debossing and/or pre-creasing the packaging material may be provided in-line in the apparatus. An arrangement for scoring the packaging material may comprise mechanical die cutting and/or laser scoring technology. An arrangement for debossing the packaging material may comprise mechanical pressing technology.

In an embodiment, the apparatus includes an arrangement for moistening and/or heating the packaging material. This may comprise apparatus for applying steam and/or moist hot air to the packaging material. In an embodiment, at least part of the package forming section is housed in a chamber and the apparatus includes a system for injecting steam and/or moist hot air into the chamber. In an embodiment, a pre-treatment chamber for moistening the packaging material is provided upstream of the package forming section through which the packaging material is conveyed before passing through the package formers. In an embodiment, the apparatus comprises one or more nozzles for directing steam and/or moist hot air on to the packaging material.

The apparatus may be configured for use in packaging items which are rigid.

The apparatus may be adapted for use in packaging items having a variety of shapes, including items which are prismatic in shape, such as block-shaped products in the form of bars, which might include candy bars, chocolate bars, and other snack type bars or food products, for example. The apparatus may be adapted for use in packaging items having irregular shapes. The apparatus may be adapted for use in packaging items comprising product placed in a rigid container. This could comprise flowable (e.g. non-rigid) product placed in a container or a plurality of rigid products grouped together in a container. For example, the apparatus may be adapted to package a plurality of products arranged in a stack in a rigid container. Such products may comprise cakes, biscuits, other foodstuff and the like.

The apparatus may be configured to package an item comprising more than one product piece.

The apparatus may be a horizontal, form, fill and seal apparatus.

The apparatus may be a vertical, form, fill and seal apparatus.

In accordance with a second aspect of the invention, there is provided apparatus for producing tubular packages sequentially from an initially generally flat, substantially continuous length of packaging material, each package enclosing one of a series of items conveyed through the apparatus in a machine direction in use, the apparatus comprising:

a) a packaging material dispenser arranged to dispense a substantially continuous length of packaging material and conveying the packaging material in the machine direction; and, b) a forming section through which the packaging material is conveyed in the machine direction, the forming section being configured to fold the packaging material from an initially flat configuration into a tubular package structure encircling an item, the forming section comprising a progressive folding region having a plurality of guide members which define a cage or funnel through which the packaging material is passed in use, wherein the guide members define a plurality of discreet elongate external guide surfaces extending generally in the machine direction, the elongate external guide surfaces being spaced apart from one another and configured for contact with an outer surface of the packaging material so as to progressively fold the packaging material about a longitudinal axis extending in the machine direction as the material passes between the guide surfaces.

The elongate external guide surfaces may be arcuate in lateral cross section.

The elongate external guide surfaces may make a line contact with the packaging material.

The apparatus according to this second aspect of the invention may have any of the features of the apparatus according to the first aspect as set out above.

In accordance with a third aspect of the invention, there is provided a method of manufacturing tubular packages sequentially from an initially generally flat, substantially continuous length of packaging material, each package enclosing one of a series of items which are conveyed in a machine direction, the method comprising:

a) dispensing a substantially continuous length of packaging material and conveying the packaging material in the machine direction; and, b) folding the packaging material into a tube-like structure by passing it through a forming section in the machine direction, the forming section being configured to fold the packaging material from its initially flat configuration into a tubular package structure encircling an item, wherein at least a part of the forming section comprises a plurality of discrete, elongate external guide surfaces extending generally in the machine direction, the elongate external guide surfaces being spaced apart from one another and configured for contact with an outer surface of the packaging material so as to progressively fold the packaging material about a longitudinal axis extending in the machine direction as the material passes between the guide surfaces.

The method according to the third aspect of the invention may be carried out using apparatus in accordance with either of the first and second aspects as set out above.

In an embodiment, the method comprises conveying items to be packaged through at least part of the forming section with the packaging material located between the items and the external elongate external guide surfaces.

The plurality of discrete, elongate external guide surfaces extending generally in the machine direction may be part of a progressive folding region of the forming section and the method may comprise passing the packaging material through a package former prior to entry of the package material into the progressive folding region, the package former defining a packaging material folding channel through which the packaging material is conveyed, the folding channel being shaped to fold the packaging material about said longitudinal axis as it passes towards and through the folding channel. The folding channel may be configured to fold side regions of the initially flat packaging material out of the plane of the initially flat packaging material. Where the machine direction is horizontal, the folding channel of the at least one package former may be configured to fold side regions of the initially flat packaging material downwardly relative to a central region of the packaging material. The method may comprise passing the packaging material through a series of package formers prior to entry of the package material into the progressive folding region, wherein the packaging material folding channels of the package formers in the series vary in shape such that the packaging material passing through the series of package formers is sequentially folded to about the longitudinal axis as it passes towards and through the folding channel of each package former in the series.

The items may be rigid items. The method may comprise folding the packaging material about each of the items in turn. The method may comprise folding the packaging material about each of the items in turn so that it conforms to the cross-sectional shape of the item. The method may be configured for use in packaging items having a variety of shapes, including items which are prismatic in shape, such as block-shaped items in the form of bars, which might include candy bars, chocolate bars, and other snack type bars. The method may be adapted for use in packaging items having irregular shapes. The method may be adapted for use in packaging items comprising product placed in a rigid container. This could comprise flowable (e.g. non-rigid) product placed in a container or a plurality of rigid products grouped together in a container. For example, the method may be adapted to package a plurality of products arranged in a stack in a rigid container. Such products may comprise cakes, biscuits, other foodstuff and the like. Each item may comprise more than one product piece. Each item may comprise a rigid container into which product has been introduced.

The packaging material may be a semi-rigid material. The term "semi-rigid" refers to materials which can be folded about an item during packaging but which is sufficiently rigid that it exhibits dead-fold characteristics. The packaging material may comprise any one or more selected from the group comprising: paperboard, cartonboard, cardboard, or a semi-rigid polymeric material, including combinations of such materials and laminated materials which include at least one layer of such materials. Where the packaging material is cartonboard, it may comprise multiple layers of fibres and may comprise at least three layers of fibres. The packaging material may comprise paperboard or cartonboard having a weight of 150 g/sqm or more. The packaging material may comprise paperboard or cartonboard having a weight in the range of 150 g/sqm to 250 g/sqm. Alternatively, where the packaging material is a semi-rigid polymeric material it may have a thickness of 150 μm or more, or a thickness of 200 μm or more. The packaging material may be coated or otherwise provided with adhesive or other material for producing seals, such as a heat sealing layer. The packaging material may be printed on and/or coated in a protective layer. The packaging material may include a metal or metallised layer and/or a barrier layer.

The method may comprise introducing the packaging material into the package forming section in a direction which is angled at no more than twenty degrees, or no more than ten degrees, or no more than five degrees, relative to a plane parallel to, or including, the longitudinal axis. Where the longitudinal axis is horizontal, the method may comprise introducing the packaging material into the package forming section in a direction which is angled at no more than twenty degrees, or no more than ten degrees, or no more than five degrees, relative to the horizontal. The method may comprise passing the packaging material through the package forming section in substantially constant plane. The method may comprise folding the packaging material substantially exclusively in a plane perpendicular to said longitudinal axis at any given point within the folding section.

The method may be carried out on a horizontal, form, fill and seal apparatus.

The method may be carried out on a vertical, form, fill and seal apparatus.

The method may comprise sealing opposed lateral edge regions of the packaging material together to form a longitudinal seal after the material has been folded about each item. The method may comprise forming a fin type seal or a lap type longitudinal seal.

The method may comprise sealing opposed portions of the packaging material together at either end of an item after it has been wrapped in the packaging material to form end seals.

The method may comprise scoring, debossing, and/or pre-creasing the material.

The method may comprise treating the packaging material with moisture and/or heating the packaging material. The method may comprise treating the packaging material with steam and/or hot moist air.

The method may comprise forming seals in the package using ultrasonic and/or radio frequency sealing techniques.

A further aspect of the invention comprises use of apparatus in accordance with either of the first and second aspects of invention set out above to produce packaging using the method of the third aspect of the invention as set out above.

DETAILED DESCRIPTION OF THE INVENTION

In order that the invention may be more clearly understood several embodiments thereof will now be described, by way of example only, with reference to the accompanying drawings, in which.

Embodiments of apparatus 10 and methods for manufacturing packaging in accordance with aspects of the invention will be described with reference to the accompanying figures. In the description and the claims, reference to the "outer surface of the packaging material" means the surface of the packaging material which is outermost when the packaging material is formed into a package. In contrast, reference to the "inner surface of the packaging material" means the surface which is innermost in the completed package and which is directed toward the packaged item.

Figure 1:
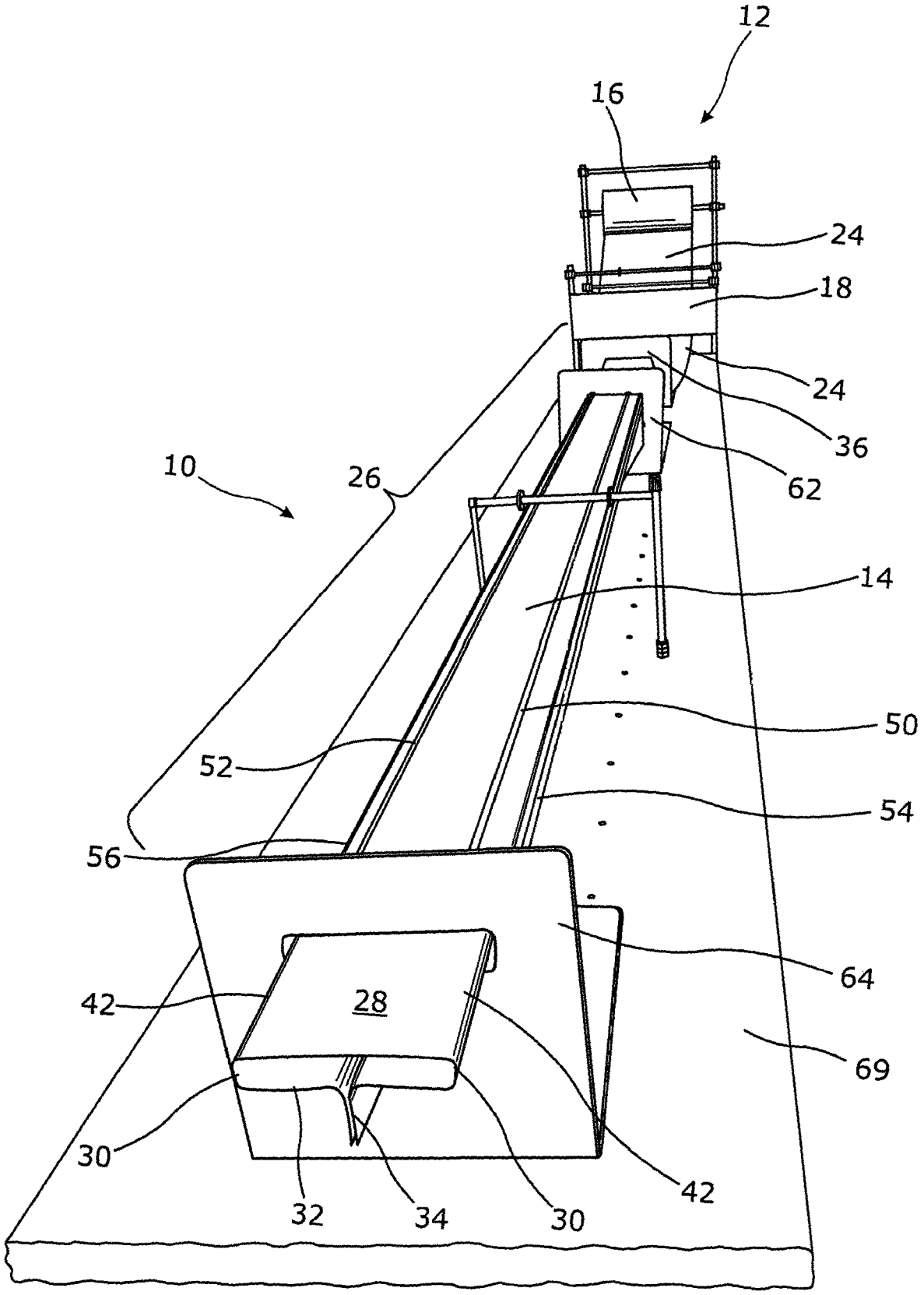
FIG. 1 is a perspective view of an embodiment of apparatus for manufacturing packaging in accordance with an aspect of the present invention, showing the apparatus with a length of packaging material extending through a package forming section of the apparatus.
Figure 2:
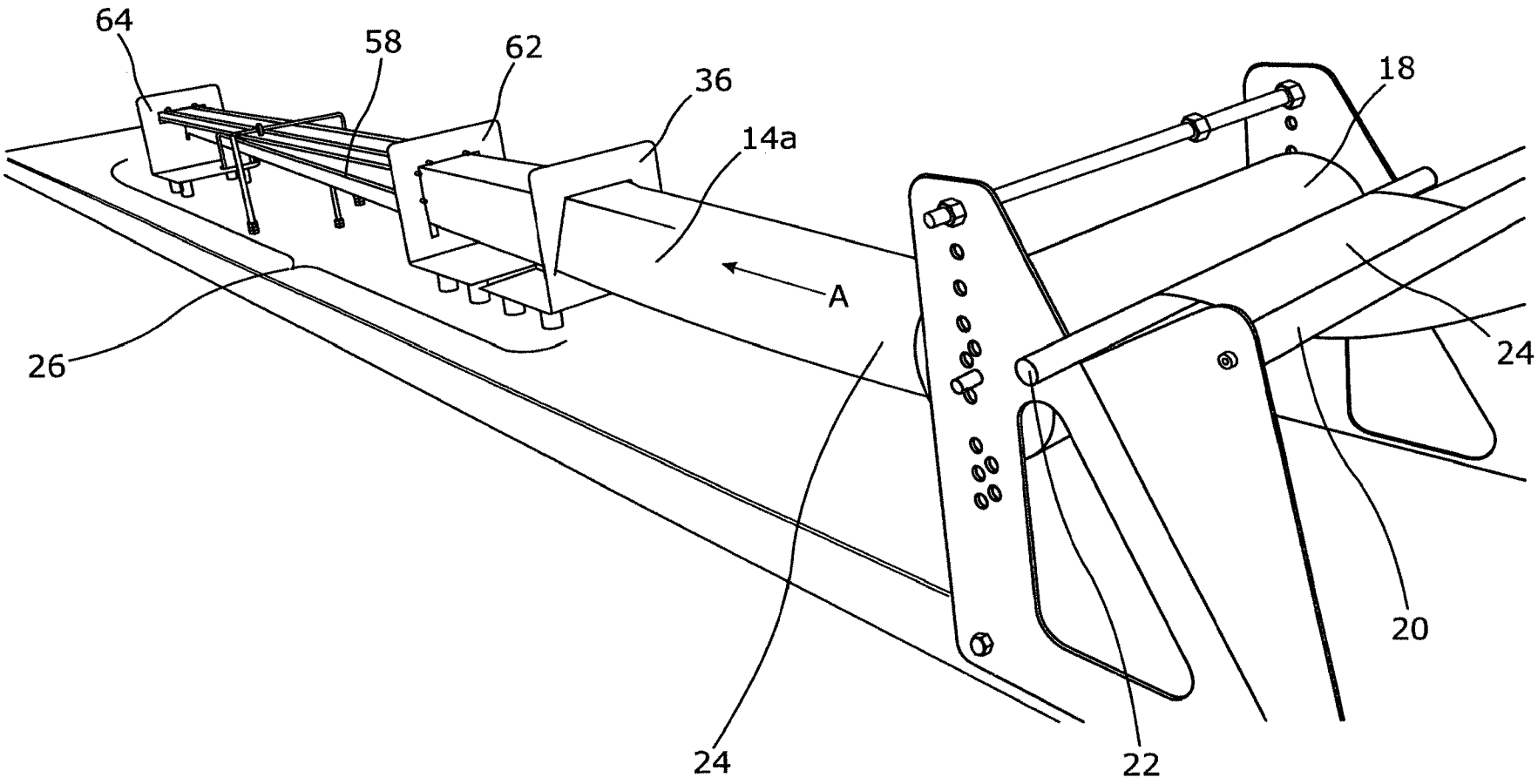
FIG. 2 is an alternative perspective view of the apparatus of FIG. 1 and also showing the apparatus with a length of packaging material extending through a forming section of the apparatus.
Figure 3:
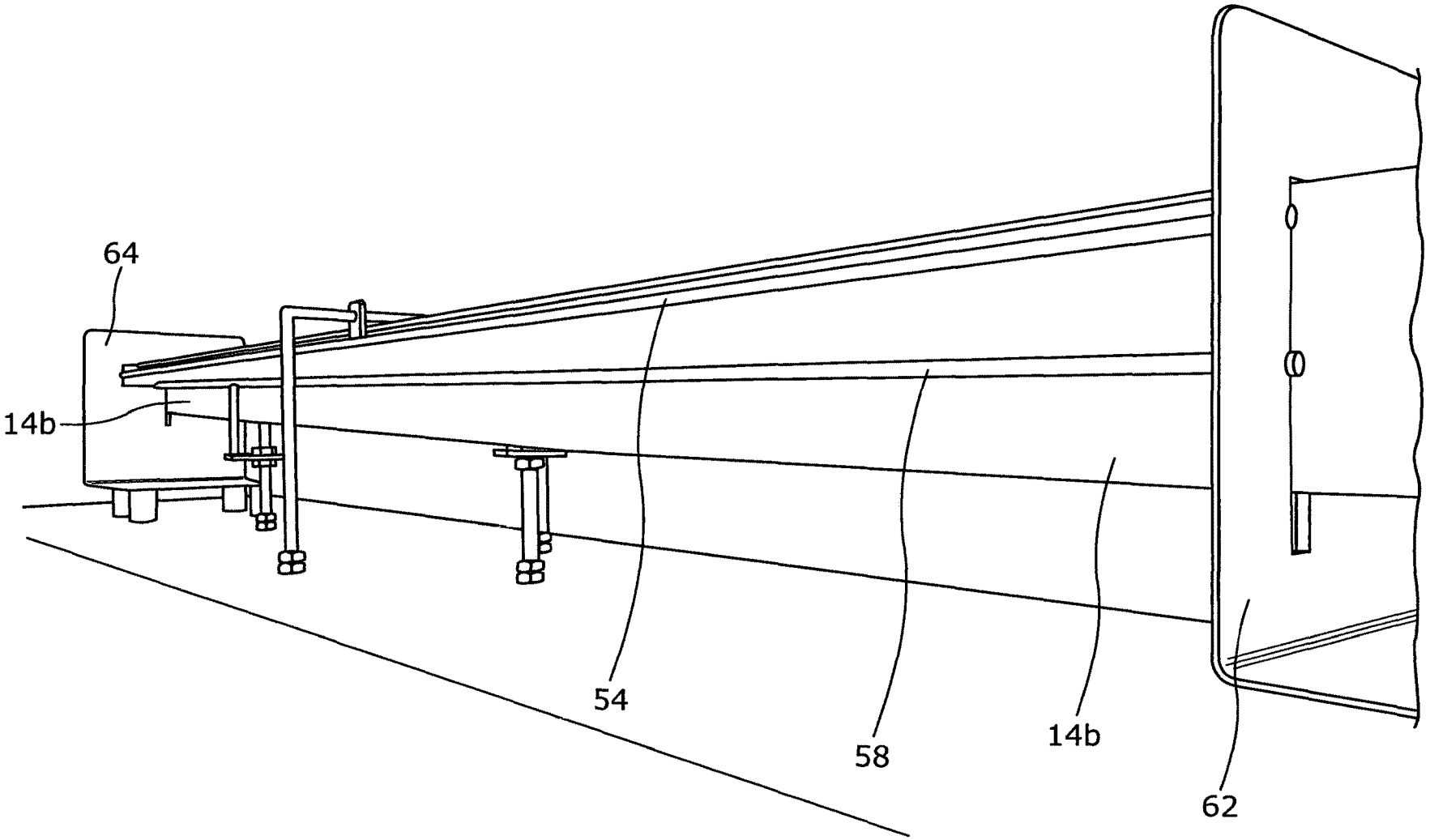
FIG. 3 is a perspective view of a progressive folding region forming part of a package forming section of the apparatus of FIG. 1 taken from one side of the apparatus and also showing the apparatus with a length of packaging material extending through the apparatus.
Figure 4:
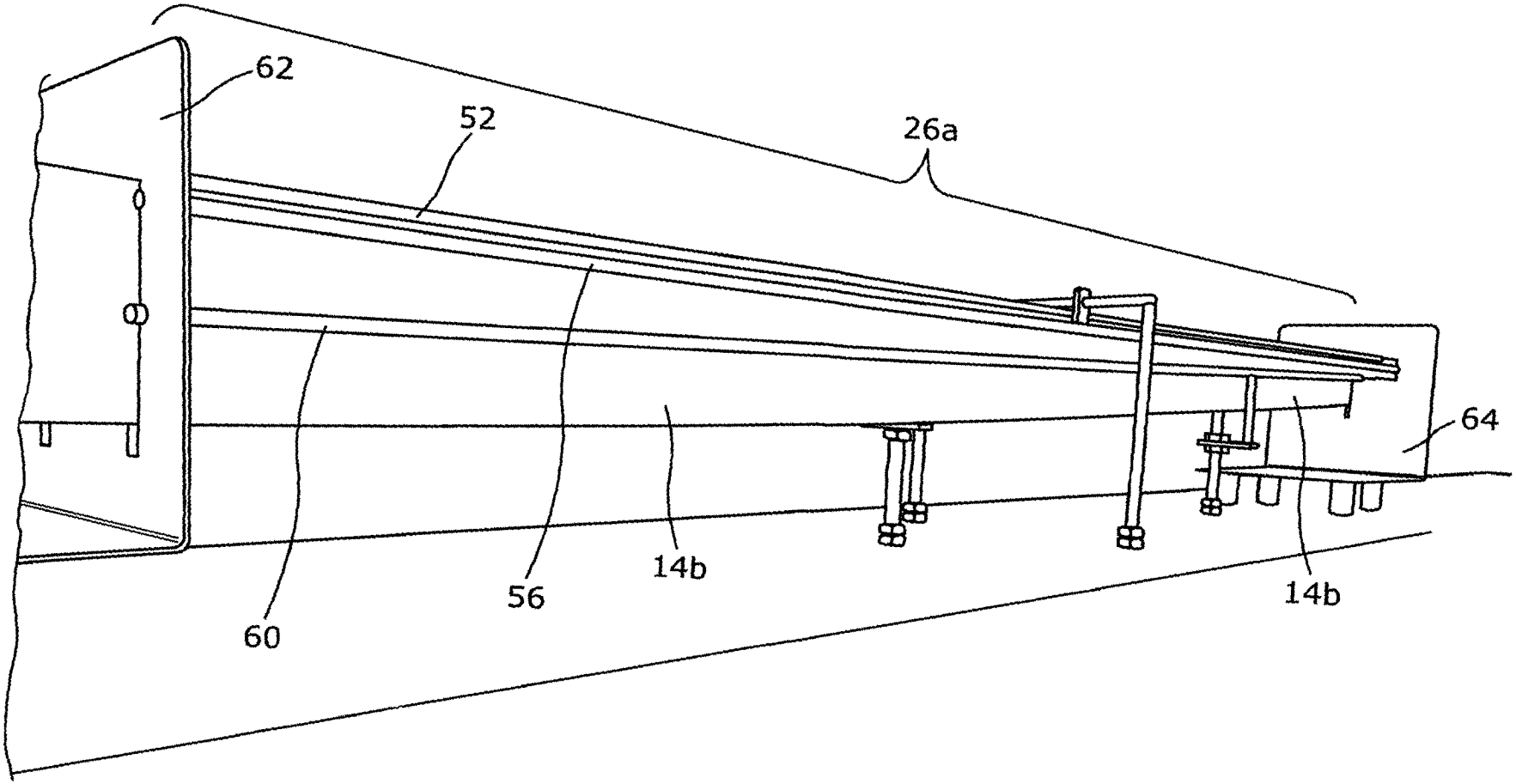
FIG. 4 is a perspective similar to that of FIG. 3 but taken from the other side of the apparatus.
Figure 5:
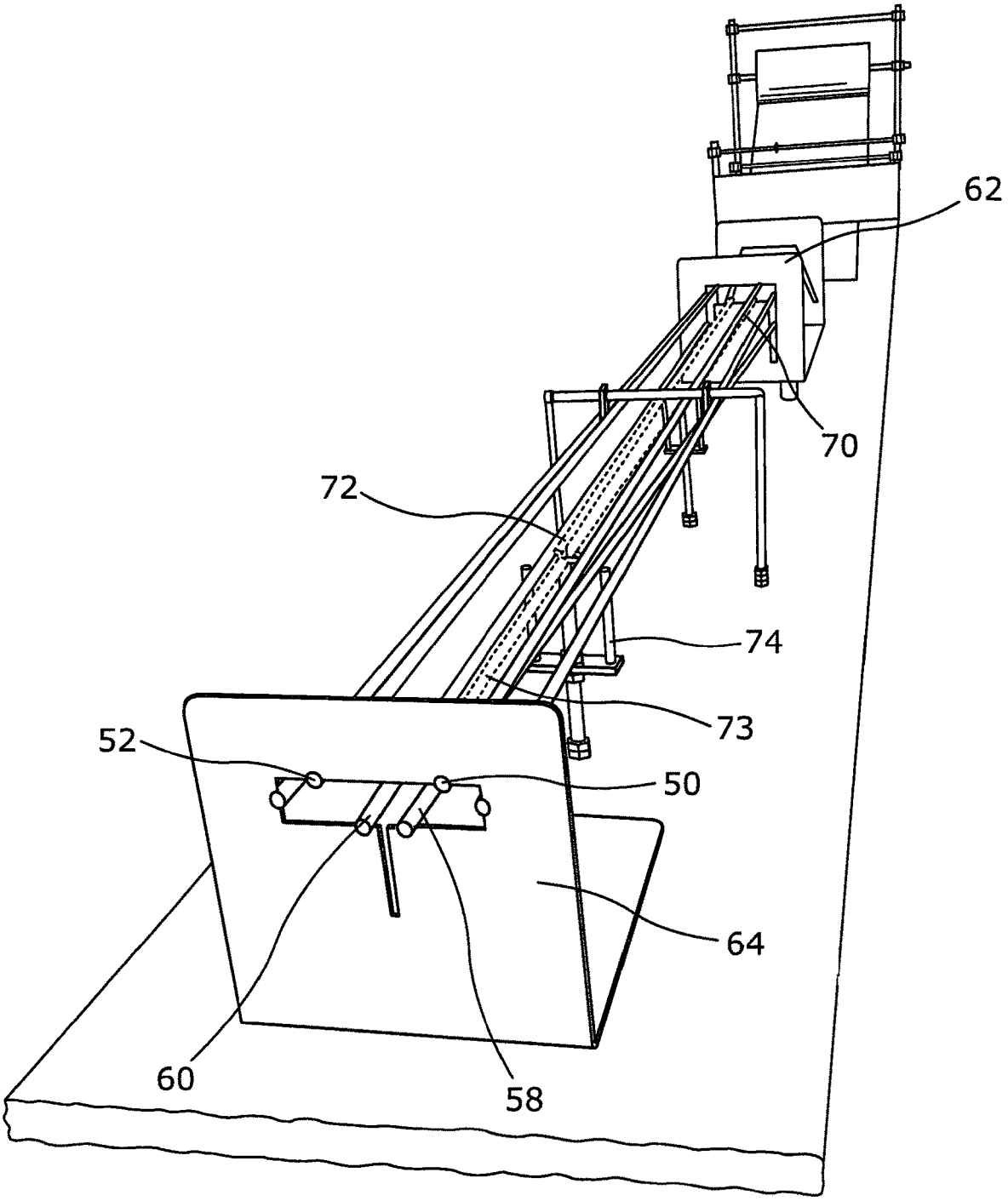
FIG. 5 is a perspective view of the apparatus of FIG. 1 but showing the apparatus without a length of packaging material extending through the forming section.
Figure 6:
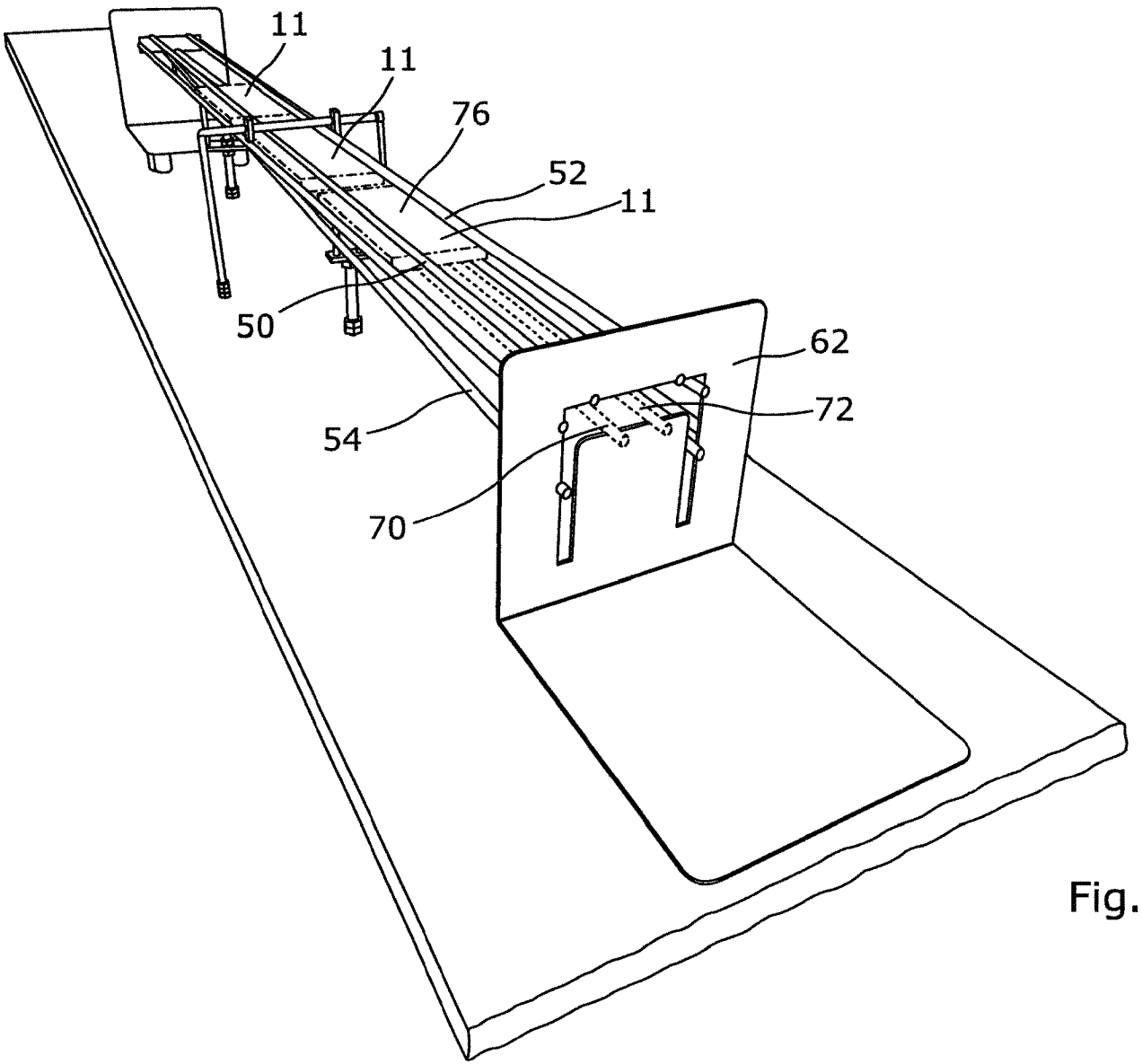
FIG. 6 is a perspective view of a progressive folding region of the apparatus of FIG. 5, looking from an upstream end towards a downstream end and illustrating how items to be packaged are conveyed through the progressive folding region.
Figure 7:
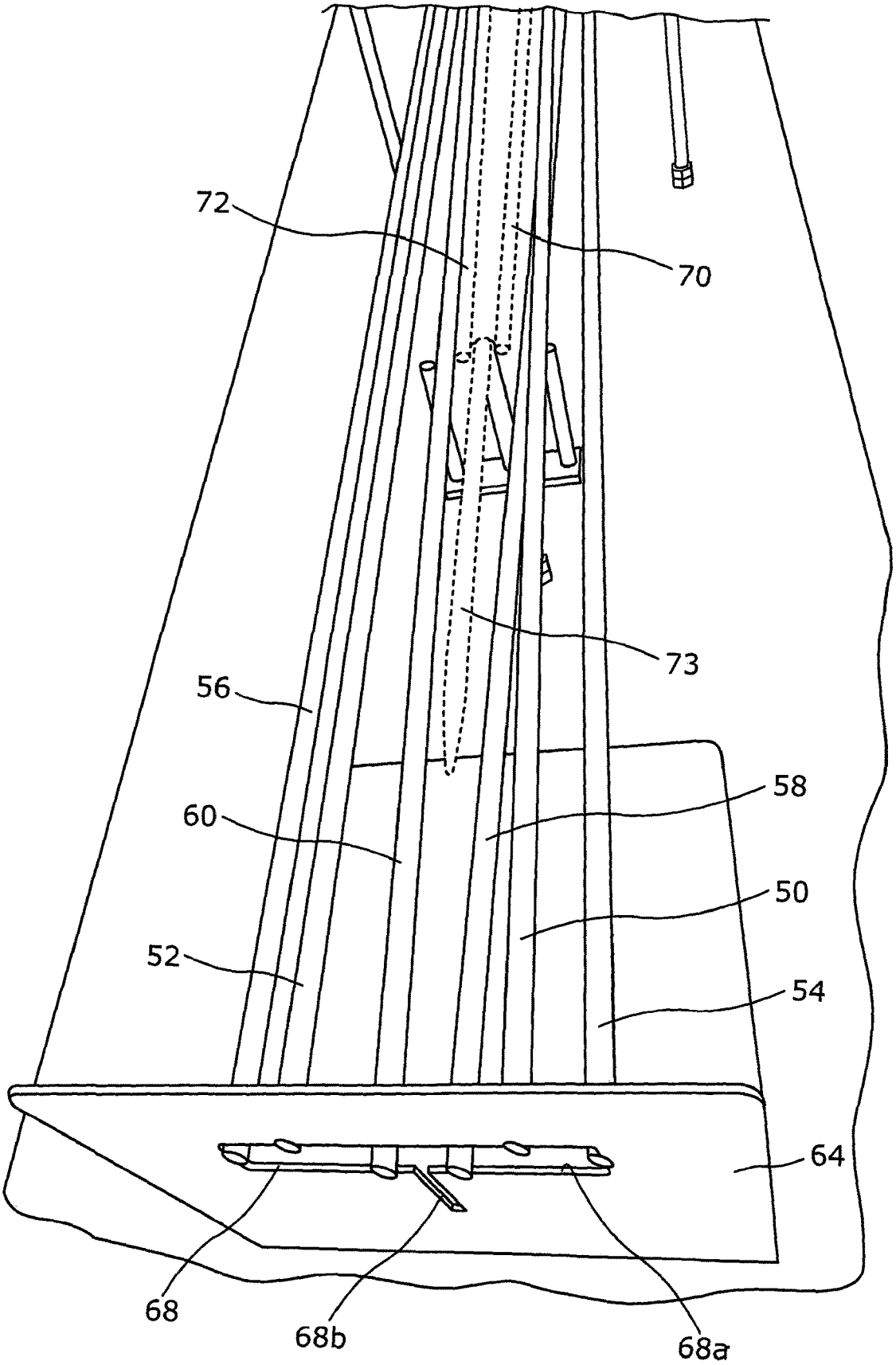
FIG. 7 is a perspective view of a downstream end of the progressive folding region shown in FIG. 6.

The apparatus 10 comprises a packaging material dispenser (indicated generally at 12) arranged to dispense a continuous, initially flat strip of packaging material 14 in a packaging conveyance or machine direction, which direction is indicated by arrow A in FIG. 2.

The apparatus is particularly adapted for use with a semi-rigid packaging materials. The term "semi-rigid" refers to or includes a material which can be folded about an item during packaging but which is sufficiently rigid that it exhibits dead-fold characteristics. The packaging material may be paperboard, cartonboard, cardboard, or a semi-rigid polymeric material, including combinations of such materials and laminated materials which include at least one layer of such materials. Cartonboard generally comprises multiple layers of fibres and may comprise at least three layers of fibres. The packaging material could comprise paperboard or cartonboard having a weight of 150 g/sqm or more and especially a weight in the range of 150 g/sqm to 250 g/sqm. However, the apparatus 10 could also be adapted for use with other semi-rigid materials including semi-rigid polymeric materials having a thickness of 150 μm or more, or a thickness of 200 μm or more.

The packaging material 14 is initially wound on a supply roll 16 and the packaging material dispenser 12 includes a mechanism for drawing the packaging material from the roll and into the machine direction A. The mechanism will typically include one or more rollers 18, 20, 22 for guiding and supporting the packaging material along the desired path and for maintaining a desired tension in the packaging material as is known in the art.

In normal use, the packaging material is dispensed from the roll 16 in a continuous length during a packaging run until the required packaging is complete or the roll is exhausted, in which case it is replaced and the process repeated. References herein to a "continuous" or "substantially continuous" length of packaging material should be understood in this context. The apparatus may have more than one supply roll which can be used alternately so that the packaging material can be replaced with minimum down time.

The apparatus 10 is a HFFS type packaging apparatus and the packaging material dispenser 12 guides the packaging material from the supply roll 16 into a generally horizontal flow path in the machine direction A, with the packaging material in an initially planer configuration as shown at 24. The apparatus 10 includes a forming section 26 which is configured to gradually fold the packaging material from its initial planar configuration into a tube-like structure which encircles a target item 11. Depending on the shape and nature of the item being packaged and the type of packaging material used, the packaging material could be wrapped closely about the item so that it conforms to the transverse cross-sectional shape of the item. However, in some applications the packaging material may be formed into a tube-like structure which surrounds the item, usually in relatively close proximity, but does not necessarily conform to its cross-sectional shape. This may be the case where the packaging material is too rigid to be able to conform to the shape of the item and/or where the item is irregular in shape. It should be understood that the term "tube-like" does not imply that the package structure is cylindrical as the packaging material can be folded into any suitable shape as required to enclose a particular item. This might include, without limitation, tube-like structures that are polygonal in transverse cross-section and which could be rectangular, triangular or hexagonal in transverse cross-section, for example.

The term "transverse" is used herein in relation to items being packaged, the apparatus 10, and the packaging material to refer to a direction orthogonal to the machine direction A in a horizontal plane, whereas the term "longitudinal" will be used to refer to a direction generally aligned with or parallel to the machine direction.

In the present embodiment, the apparatus 10 is configured to package generally block shaped items 11, such as chocolate bars having generally the shape of a rectangular prism with opposed major front and rear faces, opposed minor sides and opposed ends. Accordingly, the package forming section 26 is arranged to fold the packaging material to form packages having a generally planar major front wall region 28, opposed minor side wall regions 30, a general planer major back wall region 32 which opposes the front wall region 28, and a longitudinal seal 34. The planer back wall region 32 is defined by separate portions 32*a*, 32*b* of the packaging material, one on either side of the longitudinal seal. In the present embodiment, the longitudinal seal 34 is a fin seal but the apparatus and method could be modified to produce a lap seal. Furthermore, as noted above, the apparatus 10 and method disclosed can be adapted for forming packages in a range of different shapes employing the underlying principles taught herein.

Figure 10:
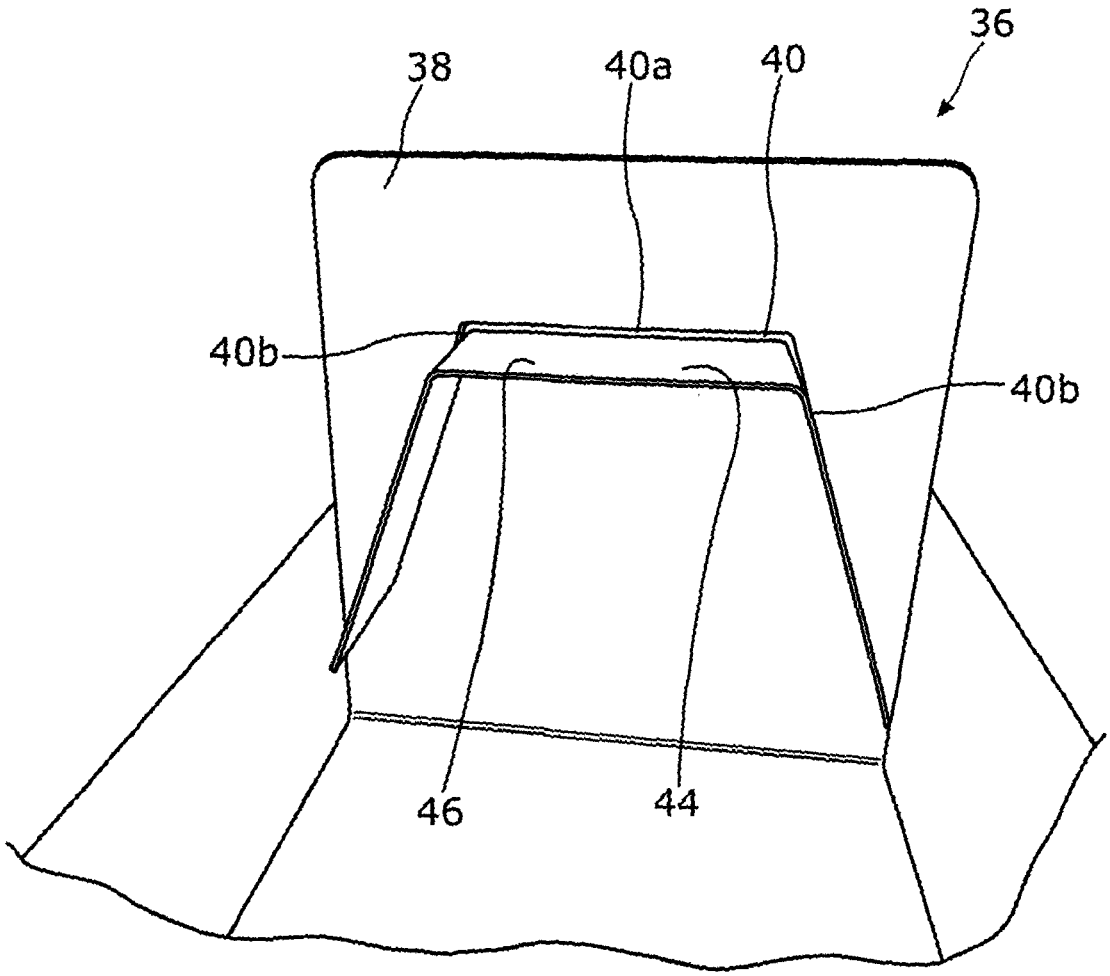
FIG. 10 is a perspective view of a downstream end of a package former which is part of the package forming section of the apparatus of FIG. 1.
Figure 11:
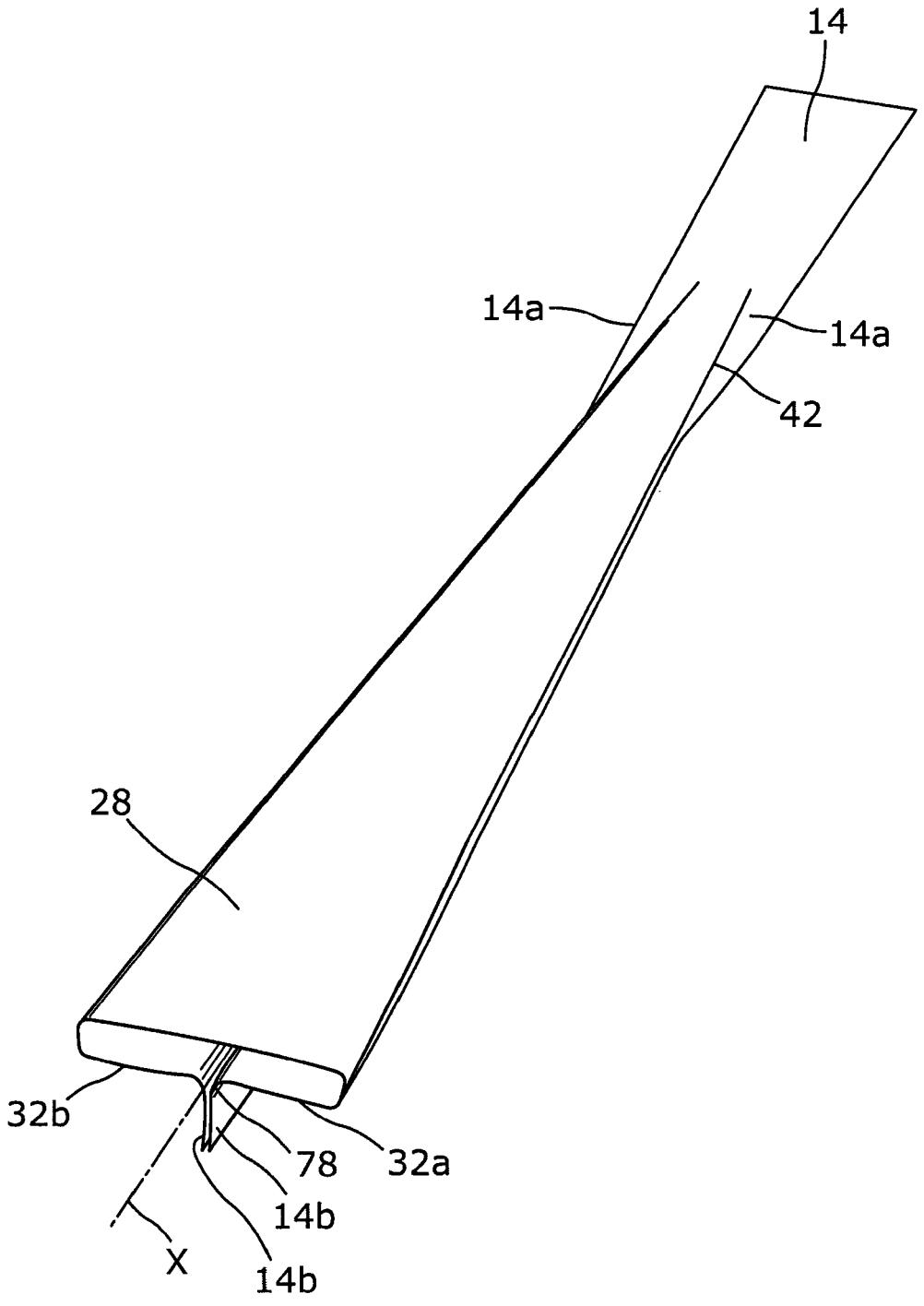
FIG. 11 is a perspective view illustrating how a length of packaging material is folded as it passes through the package forming section of the apparatus of FIGS. 1 to 10.

The forming section 26 is arranged to fold the packaging material about a longitudinal axis X extending generally horizontally in the machine direction A, as illustrated in FIG. 11. The forming section 26 includes a package former 36, the details of which can be seen best in FIG. 10. The package former 36 has a plate 38 extending orthogonally to the machine direction A, which in this case is vertically. The plate 38 has an aperture 40 through which the packaging material is drawn. The aperture 40 defines a packaging material folding channel, the inner and outer edges of which engage inner and outer surfaces of the packaging material respectively. Accordingly, the aperture 40 is in the form of a narrow slot having a depth substantially the same as or just a little larger than the thickness of the packaging material 14. The slot has a straight, upper section 40*a* extending horizontally in a lateral direction and a pair of downwardly depending side sections or legs 40*b*, one at either end of the upper section 40*a*. The side sections 40*b* extend at an obtuse angle to the upper section 40*a* so that the side sections 40*b* flare outwards from their upper ends to their lower ends. The slot 40 then is generally in the shape of an inverted "U" through which the packaging material passes. As the packaging material 14 is drawn towards and through the slot 40 in the package former 36, side regions 14*a* of the material are folded downwardly so that the packaging material defines a central front wall region 28 of the packaging and begins to form side wall regions 30, producing a fold line 42 at the intersection between the front wall region 28 and each side wall region 30.

The package former 36 also has a package material guide 44 which extends in the machine direction A from the downstream face of the plate 38. The guide is in the form of a sheet-like member having an outer surface 46 which conforms to the shape of the inner edge of the slot 40 and so that the inner surface of the packaging material 14 contacts the guide 44 after it has passed through the slot 40. This supports the packaging material 14 on the inside as the side regions 14*a* are folded down to help produce clean folds.

Downstream of the package former 36, the package forming section 26 comprises a progressive folding region 26*a*, within which the packaging material 14 is further folded about the longitudinal axis X in a progressive rather than a sequential manner to define the tube-like structure. The progressive folding region comprises a number of discrete, elongate external guide surfaces which extend generally in the machine direction for contact with the exterior surface of the packaging material 14.

The guide surfaces are configured to gradually and progressively guide the packaging material from the inverted "U" shaped configuration in which it enters the progressive folding region 26*a* into a tube-like structure encircling a target item.

In the present embodiment, there are six elongate exterior guide surfaces, each provided by a corresponding right cylindrical shaped guide member 50, 52, 54, 56, 58, 60, whose longitudinal axes are aligned substantially in the machine direction. The guide members 50, 52, 54, 56, 58, 60 each define a guide surface where they contact the packaging material. In this case where the guide members are cylindrical, the packaging material makes line contact with the outer surface of each guide member at a point about its outer circumference such that the area of contact between the packaging material and the guide member is relatively small. The guide members 50, 52, 54, 56, 58, 60 extend between and are supported by a first support plate 62 at the upstream end of the progressive folding region and a second support plate 64 located at the downstream end. The support plates 62, 64 extend orthogonally to the machine direction A, which in this case is vertically, and each define a respective aperture 66, 68 through which the packaging material 14 and items 11 to be packaged are passed in use. As can be seen in FIGS. 5, 6, 7, 8, and 9, the guide members are mounted to each of the support plates 62, 64 with their ends extending through the respective apertures 66, 68 and with their outer circumferences projecting within the cross-sectional area defined by the aperture such that the packaging material 14 engages the outer surfaces of the guide members rather than the support plates.

The aperture 66 in the upstream support plate 62 is generally in the shape of an inverted "U" having two vertically aligned legs 66*a*, 66*b* joined by an upper bridging section 66*c* which extends horizontally in a direction transverse to the machine direction A. The bridging section 66*c* is dimensioned such that the packaging material and an item to be packaged can pass through, between various of the guide members. Upstream ends of the guide members are tapered so that the packaging material 14 is guided on to the outer surfaces of the guide members without being damaged.

The aperture 68 in the downstream support plate 64 has a generally rectangular main portion 68*a* through which an item encased in the packaging material 14 is able to pass. In this embodiment, the apparatus is configured to produce packages having a longitudinal fin seal 34 formed by bonding together opposed outer lateral edge portions 14*b* of the packaging material. To help produce the fin seal, a slot 68*b* depends downwardly at the centre of the lower edge of the main portion, through which the opposed outer lateral edge portions 14*b* of the packaging material are drawn. The packaging material is contacted by the second support plate 64 where it passes through the slot 68*b* but otherwise the support plates 62, 64 do not engage the packaging material 14, unlike the package former 36.

The bridging section 66*c* of the aperture 66 in the upstream support plate 62 and the rectangular main portion 68*a* of the aperture 68 in the downstream support plate are aligned with one another on a generally common horizontal plane.

The support plates 62, 64 are both mounted to a horizontal support surface 69 on which the package former 36 is also mounted. However, the support plates 62, 64 and the package former 36 can be mounted to any suitable support structure. Indeed, it should be noted that guides members 50, 52, 54, 56, 58, 60 need not be mounted to support plates 62, 64 at all but can be supported by any suitable means.

Figure 8:
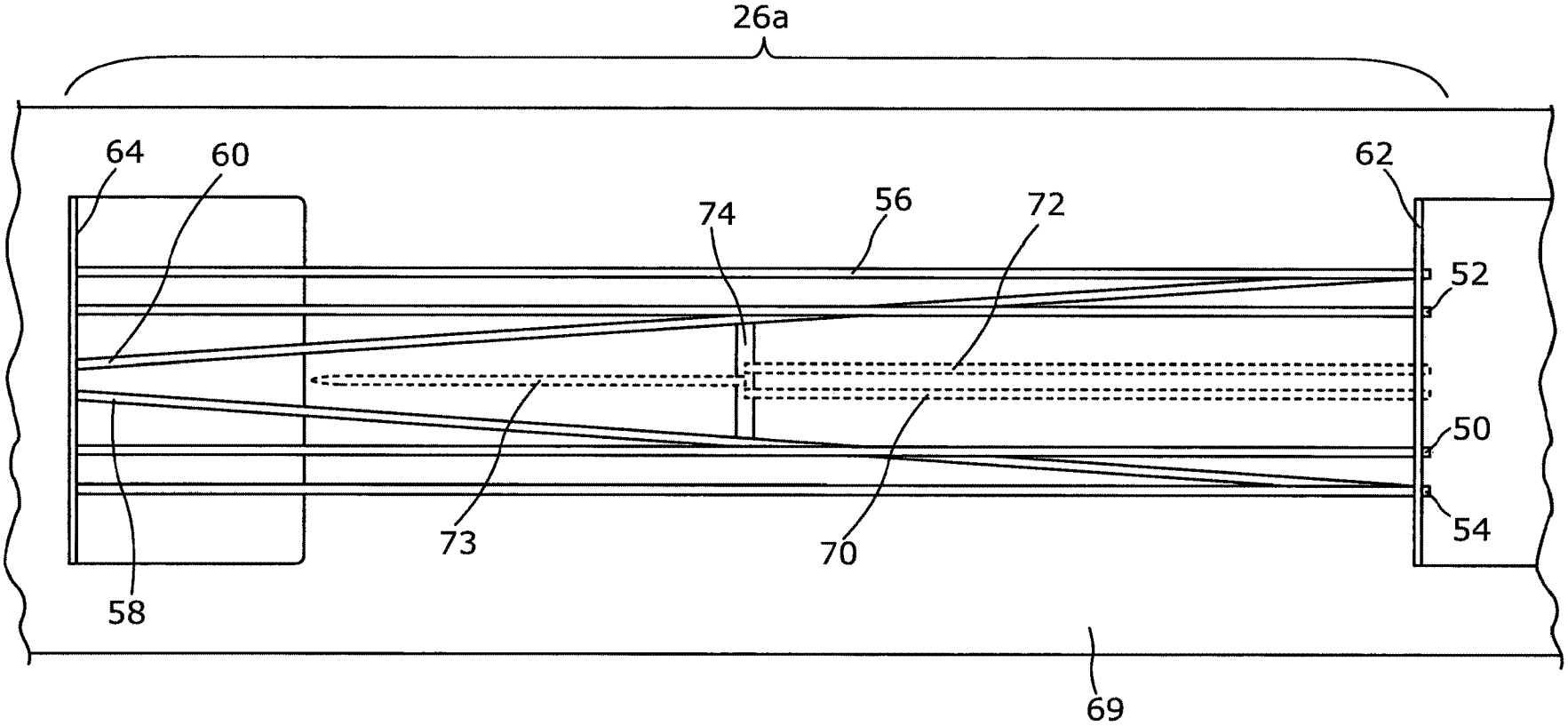
FIG. 8 is a plan view from above of the progressive folding region shown in FIG. 6.
Figure 9:
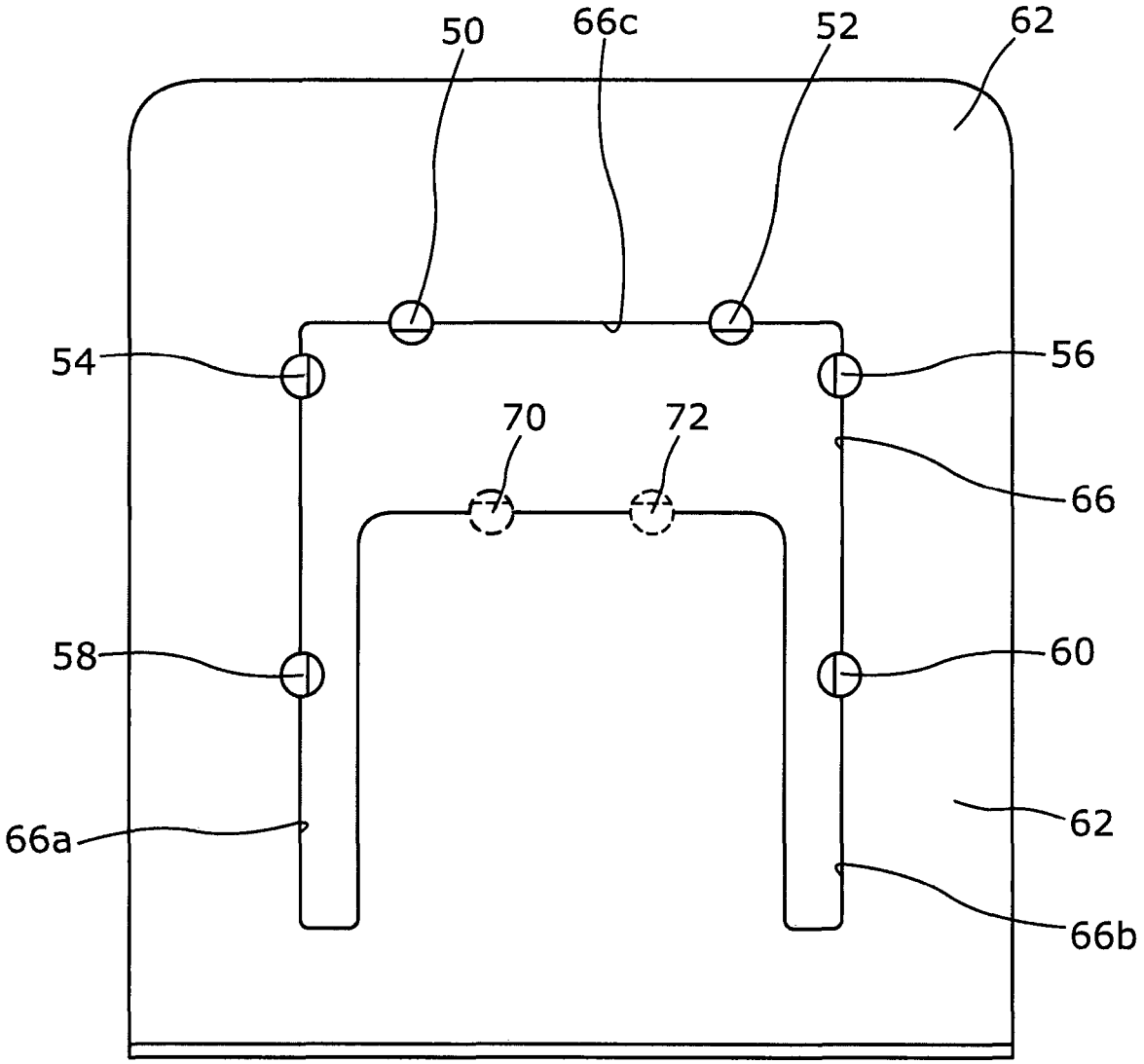
FIG. 9 is a view of an upstream end of a first support plate comprising part of the progressive folding region of the apparatus of FIG. 1.

The apparatus 10 includes an item conveyancing arrangement for conveying a series of items 11 to be packaged in the machine direction A through at least part of the package forming section 26. The item conveyancing arrangement sequentially positions each item proximal to the packaging material 14 at a location such that the packaging material 14 is subsequently folded into a tube-like structure surrounding each item as the packaging material and item progress through the package forming section. In the present embodiment, the item conveyancing arrangement is configured to introduce items 11 within the partially folded packaging material at the beginning of the progressive folding region 26*a*, downstream of the package former 36. The item conveyancing arrangement comprises an item supporting structure for supporting each item from below and which extends from the upstream support plate 62 towards the downstream support plate 64. As best seen in FIG. 8, the item supporting structure includes a pair of elongate item supporting rods 70, 72 which extend parallel to one another horizontally from the upstream support plate 62 to a supporting pillar 74 located partway between the upstream support plate 62 and the downstream support plate 64. At their upstream ends, the supporting rods 70, 72 are attached to the upstream support plate 62 adjacent the lower edge of the bridging section 66*c* and project through the plate 62. The outer circumferences of the supporting rods project above the lower edge of the bridging section 66*c* of the aperture 66. A third item supporting rod 73 extends horizontally downstream from the supporting pillar 74 and is aligned with its longitudinal axis centrally located between and parallel to the longitudinal axes of the upstream supporting rods 70, 72. All the supporting rods are the same diameter and are located in a common plane. Although not shown, the item conveyancing arrangement includes a suitable system for delivering items to be packaged sequentially into the upper bridging section 66*c* of the aperture 66 in the upstream support plate 62 so that the items are received on top of the upstream item supporting rods 70, 72. A drive mechanism is also provided to slide the items 11 along the supporting rods 70, 72, 73. The drive mechanism can take any suitable form as are known in the art, such as a recirculating chain or belt having spaced drive formations (e.g. pegs) which engage each item in turn at an upstream end to push the items along the supporting rods 70, 72, 73. The drive mechanism is calibrated to move items 11 along the supporting rods 70, 72, 73 at a constant spacing from one another and in synchronisation with the packaging material 14 as it is conveyed through the package forming section 26.

In the drawings, the item supporting rods 70. 72, 73 are shown in broken lines in order to more clearly distinguish them from the rod-like guide members 50, 52, 54, 56, 58, 60. It should be appreciated that other arrangements for supporting items for movement through the progressive folding region 26*a* can be adopted.

The six elongate external guide members 50, 52, 54, 56, 58, 60 include a pair of first or upper guide members 50, 52 which are aligned with their longitudinal axes extending parallel to one another in a common horizontal plane in the machine direction. The upper guide members 50, 52 are spaced apart laterally relative to the machine direction A, one either side of the longitudinal axis X, and are positioned so as to hold the front wall region 28 of the packaging material in close proximity to the upper major face 76 of the items 11. The upper guide members 50, 52 are each attached to the upstream support plate 62 adjacent the upper edge of the bridging section 66*c* of the aperture 66, with their outer circumferences projecting below the upper edge of the bridging section 66*c*. The minimal vertical distance between the outer circumferences of the upper guide members 50, 52 and the outer circumferences of the item supporting rods 70, 72, 73 is substantially the same or just slightly larger than the combined thickness of the packaging material 14 and one of the items 11. The upper guide members 50, 52 are similarly connected to the downstream support plate 64 at a position proximal to an upper edge of the main portion 68*a* of the aperture 68, with their outer circumferences projecting below the upper edge.

A second pair of guide members 54, 56 are aligned with their longitudinal axes extending parallel to one another in a second, common horizontal plane in the machine direction. The second pair of guide members can be referred to as side guide members and are located below the first pair 50, 52 and spaced further apart so as to hold downwardly depending regions 14*a* of the packaging material 14 in close contact with opposing sides of the items 11. The side guide members 54, 56 are connected to the support plates 62, 64 adjacent respective side edges of the bridging section 66*c* of the aperture 66 in the upstream support plate and respective side edges of the main portion 68*a* of the aperture 68 in the downstream support plate 64. The minimum horizontal distance between the outer circumferences of the side guide members 54, 56 is equal to or just slightly larger than the width of the items 11 in combination with twice the thickness of the packaging material 14.

A final pair of lower guide members 58, 60 are located below the second pair of guide members 54, 56 and are spaced apart laterally relative to the machine direction A, one either side of a central longitudinal axis of the package forming section. The lower guide members are configured to fold the side edge regions 14*a* of the packaging material upwardly to form the lower back wall region 32 of the tubular package and the fin seal 34 as the packaging material traverses from the upstream end to the downstream end of the progressive folding region 26*a*. To achieve this, the lower guide members 58, 60 are each aligned longitudinally with the locus of the point in the packaging material where a fold 78 is to be formed between the respective lower back wall section 32*a*, 32*b* and lateral outer edge region 14*b* on either side as the packaging material moves between the upstream and downstream support plates. Accordingly, each of the lower guide members 58, 60 is aligned with its longitudinal axis inclined upwardly and laterally inwardly in a direction from their upstream end toward their downstream, although it can still be said that the longitudinal axes of the lower guide members 58, 60 extend generally in the machine direction A. At their downstream end, each lower guide member 58, 60 is attached to the downstream support plate 64 adjacent the lower edge of the main aperture portion 68*a* proximal to the central slot 68*b*. At their upstream ends, each of the lower guide members 58, 60 is attached to the upstream support plate 62 adjacent to an outer edge of a respective leg 66*a*, 66*b* of the aperture 66, at a position partway down the leg. The outer circumference of each of the lower guide members 58, 60 projects inwardly of their respective leg 66*a*, 66*b* of the aperture 66 so that respective side regions 14*a* of the packaging material engage the lower guide members.

In order to initiate operation of the apparatus 10, a leading edge of the packaging material 14 may be fed manually through the slot 40 in the package former 36 and guided through the progressive folding region 26*a*, being inserted through the apertures 66, 68 in the upstream and downstream support plates within the guide members 50, 52, 54, 56, 58, 60, with the outermost lateral edge regions 14*b* of the packaging material being fed through the slot 68*b* in the downstream support plate. Once a leading portion of the packaging material has been fed through the forming section 26 and any downstream apparatus manually, it can be drawn at a steady state in the machine direction A by the packaging material dispenser, which may include means for driving the packaging material at any suitable location in the line.

When running at a steady state, the packaging material 14 will automatically conform to the shape of the aperture 40 in the package former 36 so that side regions 14*a* are folded down relative to the upper front wall region 28 as it is drawn towards and through the package former 36. This folding action is continued as the packaging material approaches the upstream support plate 62, with the side regions 14*a* being moved to extend substantially vertically downwardly as the packaging material approaches and passes through the aperture 66 in the upstream support plate 62.

With the packaging material being conveyed through the package forming section 26 at a steady state, items 11 to be packaged are introduced into the partially folded packaging material 14 at the beginning of the progressive folding region 26*a*, through the aperture 66 in the upstream support plate 62. In the progressive folding region 26*a*, the front wall region 28 of the packaging material locates between the upper guide members 50, 52 and the upper major face 76 of the items. The front wall region 28 is thus held in contact with, or at least in close proximity to, the upper major surface 76 of each item by the upper guide members. Upper portions of the side regions 14*a* of the packaging material locate down opposed sides of the items inside the side guide members and are held in contact with, or at least in close proximity to, the sides of the items by the respective side guide members 54 56.

As the packaging material enters the aperture 66 of the upstream support plate 62, the side regions 14*a* project downwardly beyond the lower guide members 58, 60. The packaging material below the lower guide members 58, 60 comprise the outer lateral edge regions 14*b* which form the fin seal 34 in the finished packaging. As the packaging material and the items progress through the progressive folding region 26*a*, the lower guide members 58, 60 are operative to cause the side regions 14*a* of the packaging material to be folded inwardly and upwardly on either side to form the back wall sections 32*a*, 32*b* of the tubular packaging which are held in contact with, or in close proximity to, the lower major surface of each item as it approaches the downstream support plate 64. However, as the outer lateral edge regions 14*b* of the packaging material are held in the slot 68*b*, these are constrained to project downwardly so that the material is folded about crease lines 78 between the outer lateral edge regions 14*b* and the respective back wall sections 32*a*, 32*b* as the packaging material approaches and passes through the downstream support plate 64.

The item supporting rods 70, 72, 73 support the items from below as they are moved from the upstream support plate 62 to a position close to the downstream support plate 64. The downstream end of the supporting rod 73 is located at a point at which the packaging material 14 is wrapped about an item 11 sufficiently tightly that the item can be supported by and carried through the aperture 68 in the downstream support plate 64 by the packaging material itself, without the need for further support. However, in some applications, support for the packaged items could be provided from below externally of the packaging material after the packing material has been folded to encircle the items. As the packaging material 14 exits the downstream support plate 64, the lateral outer edge regions 14*b* are sealed together to form a longitudinal fin seal 34 and the packaging material is crimped together and sealed at either end of each item 11 to form transverse end seals so that each item is retained in a closed and, usually, sealed package. The packaging material 14 is cut to separate each package from the remainder of the packaging material in turn and the fin seal 34 may be folded over to one side. Any suitable mechanisms can be used to produce the fin seal 34 and the transverse seals and may be similar to those used in conventional HFFS apparatus such as sealing rollers, crimp bars and the like.

The apparatus 10 can be operated in a substantially continuous manner to sequentially package a number of items 11 at relatively high speed until the supply roll 16 is exhausted, at which time it is replaced and the operation repeated.

It should be noted that the packaging material dispenser 12 aligns the packaging material 14 generally parallel to the longitudinal axis X about which the material is folded before it contacts the package former 36 and that the packaging material passes through the forming section 26 in a substantially constant plane parallel to the axis X. In particular, the upper front wall region 28 moves substantially in the same plane through the package forming section 26. In the present embodiment where the apparatus is a HFFS apparatus, the packaging material is brought into a generally horizontal flow path before engaging with the package former 36, continuing on a generally horizontal path through the whole forming section 26. As a result, the packaging material 14 is folded to a significant degree only in one direction or plane about the longitudinal axis X at any given point as it passes through the forming section 26. This is especially advantageous for semi-rigid packaging materials, reducing the tendency for the material to bulge or buckle. It will be appreciated that when producing packages of different shapes, there may not be an upper front wall region 28 but that at least part of the packaging material will pass through the whole of the forming section substantially in a constant plane so that the packaging material is folded in only one direction or plane by a substantial amount at any given time. Regardless of the shape of the package formed, it is advantageous if the forming section is configured such that the packaging material is generally only folded about a longitudinal axis parallel to the direction in which the packaging material is conveyed.

It will be appreciated that the packaging material 14 does not have to be held strictly in the same plane throughout the package forming section 26 so long as any change in angle of the packaging material in the machine direction A is relatively small and does not cause unwanted bulging and creasing. Indeed, it has been found that it can be advantageous in some applications to bring the packaging material 14 on to the package former 36 at a slight angle to the horizontal in order to control the tension in the material. However, the angle will be significantly smaller than those used in conventional flow-wrapping apparatus and methods and will typically be no more than twenty degrees, or no more than ten degrees, or no more than five degrees, relative to a plane comprising the longitudinal axis X. In tests on a HFFS apparatus, it has been found that it can be advantageous to bring the packaging material onto the package former 36 at a slight upward incline from below, with the lower edge of the roller 18 located slightly below the upper horizontal portion 40*a* of the aperture 40 in the package former 36.

The package forming section 26 is configured to minimise frictional contact with the packaging material. In this regard, the package former 36 contacts the packaging material only at a discreet position where it passes through the aperture 40 and the elongate guide members 50, 52, 54, 56, 58, 60 each make a line contact with the packaging material 14. Since the elongate external guide surfaces are spaced apart, the level of friction generated is considerably less than that which would be produced by a conventional type of former of equivalent length having a relatively wide continuous surface over which the whole or the majority of the packaging material is drawn. Accordingly, unlike conventional formers, the package former 36 and the elongate external guide surfaces in the progressive folding region define a discontinuous guide surface rather than a continuous surface which contacts a significant surface area of the packaging material. Keeping frictional contact between the apparatus and packaging material in the package forming section 26 low is particularly beneficial for use with semi-rigid packaging materials such as paperboard and cartonboard where it is expected that the length of the forming section 26 will be greater than that used in conventional flow-wrap HFFS apparatus designed for use with flexible packaging films. For use with semi-ridged packaging materials, the forming section 26 in apparatus 10 in accordance with the invention may have a length (as measured in the machine direction A) of 1 metre or more, or 1.5 metres or more, or 2 metres or more or 3 metres or more. Alternatively, the length of the forming section can be related to the length and/or the width of the packages being produced, where the length of each package is measured in a longitudinal direction from transverse end seal to transverse end seal and the width is measured transversely. In this regard, the longitudinal direction of a package will be parallel to the machine direction A when a package is being conveyed through the apparatus. Considered in relation to the length of the package, forming section 20 could have a length which is at least 3 times the length of the package, or at least 4 times the length of the package, or at least 5 times the length of the package, or at least 6 times the length of the package. Whereas when considered in relation to the width of the package, the forming section 20 may have a length which is at least 7 times the width of the package, or at least 8 times the width of the package, or at least 9 times the width of the package, or at least 10 times the width of the package. Nevertheless, in general the length of the forming section 20 will be kept to a minimum consistent with the need to produce packages of an acceptable quality and in some applications the length of the forming section could be shorter than the examples given above.

The use of guide members 50, 52, 54, 56, 58, 60 in the form of cylindrical rods is a particularly advantageous way of providing discreet elongate external guide surfaces which make minimal contact with the packaging material 14. However, it will be appreciated that the elongate external guide surfaces could be provided by other means. For example, arcuate guide surfaces could be provided by means of a convex pressing in a sheet material or on an edge of a bar or other elongate member, which need not be cylindrical. Indeed, whilst elongate external guide surfaces which are arcuate in cross-section are particularly effective, this is not necessary essential and the elongate external guide surfaces could be any suitable shape, provided they do not cause damage to the packaging material. A guide member could, for example, be in the form of a rod-like member which is polygonal in transverse cross section and which contacts the packaging material at a corner region between two adjacent faces. It should also be understood that the various elongate external guide surfaces need not be formed by identical guide members but that a variety of different guide members could be used in the apparatus 10. Furthermore, it is not essential that each elongate external guide surface is provided on a discreet guide member. Two or more of the guide surfaces could be provided on a common guide member. This could take the form of a profiled member which defines multiple but spaced elongate external guide surfaces along its length.

The elongate external guide surfaces need not be continuous throughout the progressive folding region 26*a* but could be discontinuous in the machine direction. For example, rather than each elongate external guide surface being defined by a single guide rod, each elongate external guide surface could be defined by a series of rods which are spaced apart in the machine direction. Typically, the rods in each series would be aligned on a common axis. This would help to further reduce frictional contact with the packaging material. It will be appreciated that similar arrangements for discontinuous guide surfaces can be made regardless of the type of guide member used to form each elongate external guide surface. Furthermore, the apparatus 10 could have more than one progressive folding region 26*a* arranged in series in the machine direction, with each progressive folding region having a set of elongate external guide surfaces for progressively folding the packaging material.

Whilst the elongate external guide surfaces in the embodiment described are all straight in the machine (longitudinal) direction, any one or more of the elongate external guide surfaces could be curved in the machine (longitudinal) direction. For example, one or more of the elongate external guide surfaces could be provided on a guide member which curves along its length. Such curvature may be useful in allowing the packaging material to be fed onto the guide surface without being damaged or to effect a particular folding motion of the packaging material.

As previously noted, it is not essential that the apparatus have support plates 62, 64 at either or both ends of the progressive folding region as guide members which define the elongate external guide surfaces can be supported by any suitable supporting structure. Furthermore, one or more guide members could be adjustably mounted to a support to allow for adjustment of the progressive folding region 26*a*. At the downstream end, alternative arrangements to the slot 68*b* for guiding the outer lateral edge regions 14*b* of the packaging material can be used. For example, the outer lateral edge regions 14*b* could be passed between rollers or other alternative guide arrangements to hold them in the desired orientation at the downstream end of the progressive folding region 26*a*. It should also be noted that apparatus in accordance with the invention could be adapted to produce packages having a longitudinal lap seal rather than a fin seal by appropriate reconfiguration.

In a further modification, the package forming section 26 need not include a package former 36 upstream of the progressive folding region 26*a*. Rather, a progressive folding region 26*a* can be used exclusively to guide folding of the packaging material from its initially planar configuration in to a tube-like structure. For example, the progressive folding region can be modified to carry out the initial folding of the side regions 14*a* relative to the front wall region 28. This might be achieved by modifying the upstream regions of some or all of the guide members to effect this initial folding and/or the use of additional guide surfaces extending generally in the machine direction. In some cases, it may be necessary to support the packaging material on its inner surface when folding the side regions 14*a* and this can be achieved by means of additional guide members for engagement with the inner surface of the packaging material at appropriate locations. It is though also within the scope of the invention that the apparatus comprise more than one package former 36, each defining a packaging material folding channel 40, and which can be located either upstream or downstream of the progressive folding region 26*a*. Where there are two or more package forms arranged in series in the machine direction, the packaging material folding channels of the package formers in the series may vary in shape such that, in use, packaging material passing through the series of package formers is gradually folded about the longitudinal axis as it passes through them.

The elongate external guide members 50, 52, 54, 56, 58, 60 can be said to form a cage or funnel surrounding the packaging material and which defines discrete, elongate external guide surfaces which gradually and progressively fold the packaging material into the tube-like structure. It will be noted that there are corresponding guide members and guide surfaces on each side of the apparatus (that is to say on either side of the central longitudinal axis X of the progressive folding region), though a strictly symmetrical arrangement may not be required depending on the nature of the package being formed and the packaging material 14.

The packaging material 14 may be scored or debossed to assist in folding. Scoring and debossing reduces the thickness of the packaging material to create a line of weakness along which the material can be more easily folded. Some score/debossing lines may extend longitudinally (i.e. in the machine or conveyance direction A) whilst some may extend laterally or at an angle between the two.

The packaging material 14 may be pre-scored/debossed before it is wound on the supply roll 16. Alternatively, or in addition, the apparatus 10 may include one or more arrangements for scoring/debossing the packaging material in-line after it has been drawn from the supply roll. A scoring/debossing arrangement may be provided upstream of the package former 36. Scoring arrangements may include the use of mechanical die cutting technology and/or laser scoring. Debossing in-line could be carried out using mechanical pressing technology, such as by passing the packaging material between a pair of rollers or wheels that compress the material for example.

The packaging material 14 could alternatively, or in addition, be pre-creased. Pre-creasing involves partly folding or manipulating the packaging material so that it has a permanent tendency to bend along a given line. The packaging material 14 could be pre-creased before it is wound on the supply roll and/or the apparatus may include arrangements for pre-creasing the packaging material in the line but outside of the package forming section 26. This might be carried out, for example, by passing the packaging material between a pair of male and female components that create a localised crease line.

The packaging material may be scored, debossed or pre-creased longitudinally at locations which form corners of the finished package. For example, where the package has a generally rectangular profile in cross-section, say for packaging a chocolate bar or other block shaped item 11 as in the embodiment described, the packaging material 14 may be scored or pre-creased longitudinally where the material is to be folded at the junctions between the side regions 30 and the front and rear wall regions 28, 32*a*, 32*b* respectively and/or between the rear wall sections 32*a*, 32*b* and their respective outer lateral edge regions 14*b*.

In the embodiment illustrated, the items 11 are introduced into the partially folded packaging material 14 from below. However, it should be appreciated that the process could be inverted and the items 11 fed in from above the packaging material in a top feeding arrangement. The principals described herein could also be applied to VFFS apparatus and methods.

The packaging material 14 can be sealed to form the completed package by any suitable means depending on the type of material and other packaging requirements. For example, the packaging material may be sealed using an adhesive such as, but not limited to, a heat sealable polyethylene (PE), a PE EVA blend, a PE EVA Ionomer blend, heat sealable polylactic acid copolymer or cold seal. The packaging material could be heat sealed using ultrasonic or radio frequency techniques or sealed using pressure where a cold seal is employed, for example. Indeed, any suitable sealing technique known in the art can be used. The packaging material may have sealing materials pre-applied or comprise a heat sealable layer as part of a lamination. Alternatively, or in addition, the apparatus 10 may incorporate a system for applying adhesive or other sealing materials to the packaging material 14 after it has been drawn from the supply roll 16 at any suitable location in the line. The packaging material 14 may also be printed on and/or be covered with a protective layer such as a coating of lacquer. Accordingly, reference to packaging materials comprising paperboard, cartonboard, cardboard, or paper, semi-rigid polymeric material and the like should be understood as including combinations of such materials, laminations including at least one layer of such materials, and packaging materials to which adhesive or other materials for forming seals have been applied, which may be printed on or coated with a protective layer. The packaging material may also include metal or metallised layers which provide barrier properties and/or which allow for induction heating. Other suitable barrier layers could also be included in the packaging material.

The apparatus and method of the invention are particularly suited to packaging items which retain their shape as the packaging material is formed into a tube about them during packaging. Such items are referred to as rigid, in comparison to flowable items which conform to the shape of the packaging. For products that are rigid, these may be packaged using the apparatus and method of the invention directly, with no internal packaging, although internal packaging could be used if desired. This includes a wide range of products, including block-like products in the form of bars, which might include candy bars, chocolate bars, and other snack type bars, for example. However, products which are not block shaped can also be packaged using the apparatus and method of the invention. For example, chocolate or candy products in prismatic shapes other than a block can be packaged using the apparatus and method of the invention. This might include elongate products which are shaped as triangular or hexagonal prisms. Confectionary products having an irregular shape can also be packaged using apparatus and methods of the invention. This might include products shaped like an animal or other character, for example. Other food products which are solid at the temperatures experienced during packaging can also be packaged using the apparatus and method of the invention. For example, some cheeses, cakes and biscuits could be packaged using the apparatus and method of the invention. Products which are not themselves rigid or sufficiently robust to be packaged directly could be placed in a generally rigid container and the flow-wrapped package formed about the filled container using the apparatus and/or method of the invention. Whilst the apparatus and methods of the invention are particularly suitable for packaging food products, they are not limited to such an application and can be adapted for packaging any suitable product.

It should also be understood that reference to an item being packaged in accordance with the apparatus or method according to the invention is intended to cover circumstances where more than one product piece are packaged together in a single package. For example, it is known to package two or more chocolate bars in a single package and the apparatus and method of the invention can be adapted to package multiple products together in a single package in this way, with each group of products packed in a single package being regarded as an "item".

The above embodiments are described by way of example only. Many variations are possible without departing from the scope of the invention as defined in the appended claims. For example, the apparatus could be modified to include an arrangement for moistening and/or heating the packaging material 14. This might comprise apparatus for applying steam and/or moist hot air to the packaging material. In an embodiment, at least part of the package forming section could be housed in a chamber and the apparatus provided with a system for injecting steam and/or moist hot air into the chamber. Alternatively, a pre-treatment chamber for moistening the packaging material is provided upstream of the package forming section 26 through which the packaging material is conveyed. In another possible arrangement, the apparatus can be provided with one or more nozzles for directing steam and/or moist hot air on to the packaging material 14.

The invention claimed is:

1. An apparatus for producing tubular packages sequentially from an initially generally flat, substantially continuous length of packaging material, each package enclosing one of a series of items conveyed through the apparatus in a machine direction in use, the apparatus comprising:

a packaging material dispenser arranged to dispense a substantially continuous length of packaging material and convey the material in the machine direction;

a forming section through which the packaging material is conveyed in the machine direction, the forming section being configured to fold the packaging material from an initially flat configuration into a tubular package structure, the forming section being a progressive folding region defined by a plurality of discrete, elongate external guide surfaces extending spaced apart from one another and configured to come in contact with an outer surface of the packaging material so as to progressively fold the packaging material about a longitudinal axis extending in the machine direction as the packaging material passes through the progressive folding region; and guide members which define the elongate external guide surfaces, wherein at least some of the guide members are supported by a plurality of plates provided along the progressive folding region, each of the plurality of plates having an aperture through which the packaging material and items to be packaged pass, wherein the plurality of plates comprises a first plate having a first aperture and a second plate having a second aperture, wherein the first plate and the second plate are parallel to each other and spaced apart along the progressive folding region, wherein the first aperture and the second aperture are different in shape, and wherein at least some of the guide members are positioned within the aperture of each of the plurality of plates and are spaced apart along a perimeter of the aperture of each of the plurality of plates.

2. The apparatus as claimed in claim 1, wherein, when considered from an upstream end to a downstream end, at least some of the external elongate guide surfaces may be angled laterally inwardly and in a direction perpendicular to the machine direction.

3. The apparatus as claimed in claim 1, wherein at least one of the guide members comprises a cylindrical rod.

4. The apparatus as claimed in claim 1, wherein the elongate external guide surfaces are configured to define a cage or funnel through which the packaging material is passed in use.

5. The apparatus as claimed in claim 1, the apparatus further comprising an item conveyancing arrangement for conveying a series of items to be packaged in the machine direction and sequentially positioning each item proximal to the packaging material at a location such that, in use, inserted items are conveyed through at least part of the progressive folding region between the elongate external guide surfaces, with the packaging material positioned between the items and the elongate external guide surfaces.

6. The apparatus as claimed in claim 1, wherein the forming section comprises at least one package former, the, or each, package former defining a packaging material folding channel through which the packaging material is conveyed, the folding channel of the, or each, of the package formers being shaped to fold the packaging material about said longitudinal axis as it passes towards and through the folding channel in use.

7. The apparatus as claimed in claim 6, wherein at least one package former is located upstream of the progressive folding region in the machine direction and is configured to fold side regions of the packaging material out of the plane of the initially flat packaging material.

8. The apparatus as claimed in claim 1, wherein the apparatus is configured to package generally block shaped items having opposed first and second major faces and opposed sides, the progressive folding region comprising at least one first elongate external guide surface configured for holding the packaging material proximal the first major face of items conveyed through the progressive folding region and a pair of second elongate external guide surfaces, each second elongate external guide surface configured to hold a portion of the packaging material proximal one of the opposed sides of the items.

9. The apparatus as claimed in claim 8, wherein the progressive folding region further comprises a pair of third elongate external guide surfaces, each third elongate external guide surface being configured to progressively fold a respective side region of the packaging material into close proximity with the second major face of the items as the packaging material and items traverse from an upstream end of the progressive folding region to a downstream end.

10. The apparatus as claimed in claim 8, wherein the apparatus is configured to produce packages in which outer lateral edge regions of the packaging material are sealed together to form a longitudinal fin seal, the apparatus comprising a guide arrangement at a downstream end of the progressive folding region for holding the outer lateral edge portions of the packaging material in close proximity.

11. The apparatus as claimed in claim 1, wherein the progressive folding region extends over a length in the machine direction of 1m or more.

12. The apparatus as claimed in claim 1, wherein the apparatus is configured such that at least part of the packaging material travels through the entire forming section in a substantially constant plane substantially parallel with said longitudinal axis.

13. The apparatus as claimed in claim 1, wherein the packaging material is a semi-rigid packaging material.

14. The apparatus as claimed in claim 1, wherein the guide members are configured to support the packaging material and items to be packaged without a conveyor.

15. A method of producing tubular packages sequentially from an initially generally flat, substantially continuous length of packaging material, each package enclosing one of a series of items which are conveyed in a machine direction, the method comprising:

dispensing a substantially continuous length of packaging material and conveying the packaging material in the machine direction; and, folding the packaging material into a tube-like structure by passing the packaging material through a forming section in a machine direction, the forming section being configured to fold the packaging material from initially flat configuration into a tubular package structure, wherein the forming section being a progressive folding region defined by a plurality of discrete, elongate external guide surfaces extending spaced apart from one another and configured to come in contact with an outer surface of the packaging material so as to progressively fold the packaging material about a longitudinal axis extending in the machine direction as the packaging material passes between the guide surfaces, wherein guide members define the elongate external guide surfaces, and wherein at least some of the guide members are supported by a plurality of plates along the progressive folding region, each of the plurality of plates having an aperture through which the packaging material and items to be packaged pass, wherein the plurality of plates comprises a first plate having a first aperture and a second plate having a second aperture, wherein the first plate and the second plate are parallel to each other and spaced apart along the progressive folding region, wherein the first aperture and the second aperture are different in shape, and wherein at least some of the guide members are positioned within the aperture of each of the plurality of plates and are spaced apart along a perimeter of the aperture of each of the plurality of plates.

16. The method as claimed in claim 15, wherein the packaging material is a semi-rigid packaging material.

17. The method as claimed in claim 15, wherein the packaging material comprises any one or more selected from the group comprising: paperboard, cartonboard, cardboard, or a semi-rigid plastics.

18. The method as claimed in claim 15, wherein the method comprises conveying items to be packaged through the progressive folding region with the packaging material located between the items and the elongate external guide surfaces.

19. The method as claimed in claim 15, wherein the method comprises maintaining at least part of the packaging material in a substantially constant plane as it passes through the forming section.

20. The method as claimed in claim 15, wherein the guide members are configured to support the packaging material and items to be packaged without a conveyor.

* * * * *